US005458698A

United States Patent [19]

Bershas et al.

[11] Patent Number: 5,458,698

[45] **Date of Patent: * Oct. 17, 1995**

[54] AQUEOUS LUBRICANT AND SURFACE CONDITIONER FOR FORMED METAL SURFACES

[75] Inventors: James P. Bershas, West Bloomfield; Timm L. Kelly, Birmingham; Gary L. Rochfort, Troy, all of Mich.

[73] Assignee: Henkel Corporation, Plymouth Meeting, Pa.

[ * ] Notice: The portion of the term of this patent subsequent to Jan. 14, 2009 has been disclaimed.

[21] Appl. No.: 109,791

[22] Filed: Sep. 23, 1993

Related U.S. Application Data

[63] Continuation-in-part of Ser. No. 910,483, Jul. 8, 1992, abandoned, which is a continuation-in-part of Ser. No. 785,635, Oct. 31, 1991, abandoned, which is a continuation of Ser. No. 521,219, May 8, 1990, Pat. No. 5,080,814, which is a continuation of Ser. No. 395,620, Aug. 18, 1989, Pat. No. 4,944,889, which is a continuation-in-part of Ser. No. 57,129, Jun. 1, 1987, Pat. No. 4,859,351.

[51] Int. Cl.[6] ..... C10M 173/00; B65D 75/00

[52] U.S. Cl. ..... 148/246; 148/274; 252/49.3; 252/49.8; 252/49; 427/239; 427/309; 427/327

[58] Field of Search ..... 252/49.3, 49.8, 252/49.1; 156/665; 148/246, 274

[56] References Cited

U.S. PATENT DOCUMENTS

| | | | |
|---|---|---|---|
| 3,431,182 | 3/1969 | Frant | 204/1 |
| 4,260,499 | 4/1981 | Fein et al. | 252/32 |
| 4,490,536 | 12/1984 | Corti et al. | 548/112 |
| 4,710,409 | 12/1987 | Lahaye | 427/421 |
| 4,859,351 | 8/1989 | Awad | 252/32 |
| 4,921,552 | 5/1990 | Sander et al. | 14.8/247 |
| 4,944,889 | 7/1990 | Awad | 252/32 |
| 5,030,323 | 7/1991 | Awad | 156/665 |
| 5,061,389 | 10/1991 | Reichgott | 252/49.3 |
| 5,064,500 | 11/1991 | Awad | 156/665 |
| 5,139,586 | 8/1992 | Das | 427/421 |

*Primary Examiner*—Sam Silverberg

*Attorney, Agent, or Firm*—Ernest G. Szoke; Wayne C. Jaeschke; Norvell E. Wisdom, Jr.

[57] ABSTRACT

A lubricant and surface conditioner for formed metal surfaces, particularly aluminum and tin beverage containers, reduces the coefficient of static friction of said metal surfaces and enables drying said metal surfaces at a lower temperature. The conditioner includes a water-soluble organic material selected from alkoxylated or non-alkoxylated castor oil triglycerides and hydrogenated castor oil derivatives; alkoxylated and nonoalkoxylated amine salts of a fatty acid including mono-, di-, tri-, and poly-acids; alkoxylated and non-alkoxylated amino fatty acids; alkoxylated and non-alkoxylated fatty amine N-oxides, alkoxylated and non-alkoxylated quaternary ammonium salts, oxa-acid esters, and water-soluble alkoxylated and non-alkoxylated polymers.

18 Claims, 1 Drawing Sheet

AQUEOUS LUBRICANT AND SURFACE CONDITIONER FOR FORMED METAL SURFACES

CROSS-REFERENCE TO RELATED APPLICATIONS

This application is a continuation-in-part of application Ser. No. 910,483 filed July 8, 1992, now abandoned which was a continuation-in-part of application Ser. No. 785,635 filed October 31, 1991 and now abandoned, which was a continuation of application Ser. No. 521,219 filed May 8, 1990, now U.S. Pat. No. 5,080,814, which was a continuation of application Ser. No. 395,620 filed Aug. 18, 1989, now U.S. Pat. No. 4,944,889, which was a continuation-in-part of Ser. No. 07/ 057,129 filed June 1, 1987, now U.S. Pat. No. 4,859,351. The entire disclosures of all the aforementioned patents, to the extent not inconsistent with any explicit statement herein, are hereby incorporated herein by reference.

BACKGROUND OF THE INVENTION

1. Field of the Invention

This invention relates to processes and compositions which accomplish at least one, and most preferably all, of the following related objectives when applied to formed metal surfaces, more particularly to the surfaces of cleaned aluminum and/or tin plated cans: (i) reducing the coefficient of static friction of the treated surfaces after drying of such surfaces, without adversely affecting the adhesion of paints or lacquers applied thereto; (ii) promoting the drainage of water from treated surfaces, without causing "water-breaks", i.e., promoting drainage that results in a thin, continuous film of water on the cans, instead of distinct water droplets separated by the relatively dry areas called "water-breaks" between the water droplets; and (iii) lowering the dryoff oven temperature required for drying said surfaces after they have been rinsed with water.

2. Discussion of Related Art

The following discussion and the description of the invention will be set forth primarily for aluminum cans, as these represent the largest volume area of application of the invention. However, it is to be understood that, with the obviously necessary modifications, both the discussion and the description of the invention apply also to tin plated steel cans and to other types of formed metal surfaces for which any of the above stated intended purposes of the invention is practically interesting.

Aluminum cans are commonly used as containers for a wide variety of products. After their manufacture, the aluminum cans are typically washed with acidic cleaners to remove aluminum fines and other contaminants therefrom. Recently, environmental considerations and the possibility that residues remaining on the cans following acidic cleaning could influence the flavor of beverages packaged in the cans has led to an interest in alkaline cleaning to remove such fines and contaminants. However, the treatment of aluminum cans with either alkaline or acidic cleaners generally results in differential rates of metal surface etch on the outside versus on the inside of the cans. For example, optimum conditions required to attain an aluminum fine-free surface on the inside of the cans usually leads to can mobility problems on conveyors because of the increased roughness on the outside can surface.

Aluminum cans that lack a low coefficient of static friction (hereinafter often abbreviated as "COF") on the outside surface usually do not move past each other and through the trackwork of a can plant smoothly. Clearing the jams resulting from failures of smooth flow is inconvenient to the persons operating the plant and costly because of lost production. The COF of the internal surface is also important when the cans are processed through most conventional can decorators. The operation of these machines requires cans to slide onto a rotating mandrel which is then used to o transfer the can past rotating cylinders which transfer decorative inks to the exterior surface of the cans. A can that does not slide easily on or off the mandrel can not be decorated properly and results in a production fault called a "printer trip". In addition to the misloaded can that directly causes such a printer trip, three to four cans before and after the misloaded one are generally lost as a consequence of the mechanics of the printer and conveyor systems. Jams and printer trips have become increasingly troublesome problems as line speed have increased during recent years to levels of about 1200 to 1500 cans per minute that are now common. Thus, a need has arisen in the can manufacturing industry, particularly with aluminum cans, to modify the COF on the outside and inside surfaces of the cans to improve their mobility.

An important consideration in modifying the surface properties of cans is the concern that such modification may interfere with or adversely affect the ability of the can to be printed when passed to a printing or labeling station. For example, after cleaning the cans, labels may be printed on their outside surface, and lacquers may be sprayed on their inside surface. In such a case, the adhesion of the paints and lacquers is of major concern. It is therefore an object of this invention to improve mobility without adversely affecting adhesion of paints, decorating inks, lacquers, or the like.

In addition, the current trend in the can manufacturing industry is directed toward using thinner gauges of aluminum metal stock. The down-gauging of aluminum can metal stock has caused a production problem in that, after washing, the cans require a lower drying oven temperature in order to pass the column strength pressure quality control test. However, lowering the drying oven temperature resulted in the cans not being dry enough when they reached the printing station, and caused label ink smears and a higher rate of can rejects.

One means of lowering the drying oven temperature would be to reduce the amount of water remaining on the surface of the cans after water rinsing. Thus, it is advantageous to promote the drainage of rinse water from the treated can surfaces. However, in doing so, it is generally important to prevent the formation of surfaces with water-breaks as noted above. Such water-breaks give rise to at least a perception, and increase the possibility in reality, of non-uniformity in practically important properties among various areas of the surfaces treated.

Thus, it is desirable to provide a means of improving the mobility of aluminum cans through single filers and printers to increase production, reduce line jammings, minimize down time, reduce can spoilage, improve or at least not adversely affect ink laydown, and enable lowering the drying oven temperature of washed cans.

In the most widely used current commercial practice, at least for large scale operations, aluminum cans are typically subjected to a succession of six cleaning and rinsing operations as described in Table 1 below. (Contact with ambient temperature tap water before any of the stages in Table 1 is sometimes used also; when used, this stage is often called a "vestibule" to the numbered stages.)

TABLE 1

| STAGE NUMBER | ACTION ON SURFACE DURING STAGE |
|---|---|
| 1 | Aqueous Acid Precleaning |
| 2 | Aqueous Acid and Surfactant Cleaning |
| 3 | Tap Water Rinse |
| 4 | Mild Acid Postcleaning, Conversion Coating, or Tap Water Rinse |
| 5 | Tap Water Rinse |
| 6 | Deionized ("DI") Water Rinse |

It is currently possible to produce a can which is satisfactorily mobile and to which subsequently applied inks and/or lacquers have adequate adhesion by using suitable surfactants either in Stage 4 or Stage 6 as noted above. Preferred treatments for use in Stage 6 are described in U.S. Pats. 4,944,889 and 4,859,351, and some of them are commercially available from the Parker+Amchem Division of Henkel Corporation (hereinafter often abbreviated as "P+A") under the name "Mobility Enhancer™ 40" (herein often abbreviated "ME-40™").

However, many manufacturers have been found to be reluctant to use chemicals such as ME-40™ in Stage 6. In some cases, this reluctance is due to the presence of a carbon filter for the DI water (normal Stage 6) system, a filter that can become inadequately effective as a result of adsorption of lubricant and surface conditioner forming additives such as those in ME-40™; in other cases, it is due to a reluctance to make the engineering changes necessary to run ME-40.

For those manufacturers that prefer not to add any lubricant and surface conditioner material to the final stage of rinsing but still wish to achieve the advantages that can be obtained by such additions, alternative treatments for use in Stage 4 as described above have been developed and are described in U.S. Pat. Nos. 5,030,323 and 5,064,500. Some of these materials are commercially available from P+A under the name FIXODINE™ 500.

However, the reduction in coefficient of friction provided by prior art treatments in either Stage 4 or Stage 6 can be substantially reduced, often to an unacceptable level, if the treated cans are subjected to extraordinary heating after completion of the six process stages described above. Such extraordinary heating of the cans in the drying oven occurs whenever a high speed production line is stalled for even a few minutes, an event that is by no means rare in practice. In practical terms, the higher COF measurements correlate with the loss of mobility, thereby defeating the purpose of introducing mobility enhancing surfactants into can washing formulations. Accordingly, it is an object of this invention to provide means of improving the mobility of aluminum cans and/or one of the other objects stated above that are superior to means taught in the prior art, particularly with respect to stability of the beneficial effects to heating well beyond the minimum extent necessary for drying the treated surfaces.

DESCRIPTION OF THE INVENTION

Other than in the operating examples, or where otherwise indicated, all numbers expressing quantities of ingredients or reaction conditions used herein are to be understood as modified in all instances by the term "about" in describing the broadest scope of the invention. Practice within the numerical limits given, however, is generally preferred.

Also, unless there is an explicit statement to the contrary, the description below of groups of chemical materials as suitable or preferred for a particular ingredient according to the invention implies that mixtures of two or more of the individual group members are equally as suitable or preferred as the individual members of the group used alone. Furthermore, the specification of chemical materials in ionic form should be understood as implying the presence of some counterions as necessary for electrical neutrality of the total composition. In general, such countefions should first be selected to the extent possible from the ionic materials specified as part of the invention; any remaining counterions needed may generally be selected freely, except for avoiding any counterions that are detrimental to the objects of the invention.

SUMMARY OF THE INVENTION

In accordance with this invention, it has been found that a lubricant and surface conditioner applied to aluminum cans after washing enhances their mobility and, in a preferred embodiment, improves their water film drainage and evaporation characteristics as to enable lowering the temperature of a drying oven by from about 25° to about 100° F without having any adverse effect on the label printing process. The lubricant and surface conditioner reduces the coefficient of static friction on the outside surface of the cans, enabling a substantial increase in production line speeds, and in addition, provides a noticeable improvement in the rate of water film drainage and evaporation resulting in savings due to lower energy demands while meeting quality control requirements.

DESCRIPTION OF THE PREFERRED EMBODIMENTS

Figure 1B:
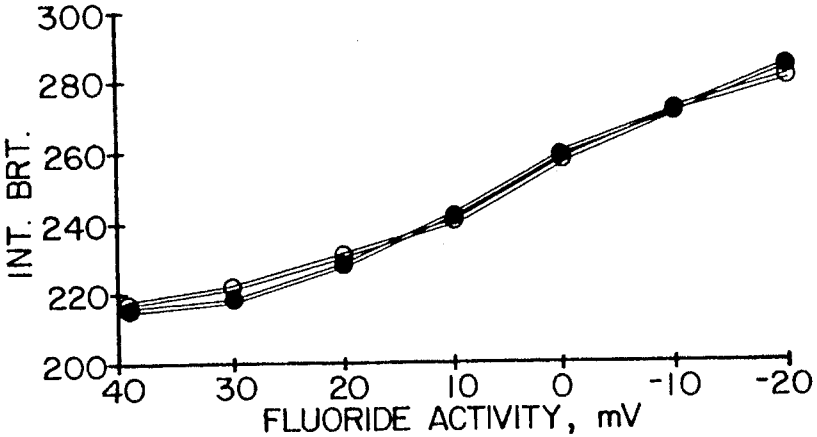
FIGS. 1(*a*)–1(*d*) illustrate the effect of fluoride activity during cleaning of cans before applying a lubricant and surface conditioner according to this invention on the characteristics of the cans after processing.

More particularly, in accordance with one preferred embodiment of this invention, it has been found that application of a thin organic film to the outside surface of aluminum cans serves as a lubricant inducing thereto a lower coefficient of static friction, which consequently provides an improved mobility to the cans, and also increases the rate at which the cans may be dried and still pass the quality control column strength pressure test. It has also been found that the degree of improved mobility and drying rate of the cans depends on the thickness or amount of the organic film, and on the chemical nature of the material applied to the cans.

The lubricant and surface conditioner for aluminum cans in accordance with this invention may, for example, be selected from water-soluble alkoxylated surfactants such as organic phosphate esters; alcohols; fatty acids including mono-, di-, tri-, and poly-acids; fatty acid derivatives such as salts, hydroxy acids, amides, esters, particularly alkyl esters of 2-substituted alkoxylated fatty alkyloxy acetic acids (briefly denoted hereinafter as "oxa-acid esters") as described more fully in U.S. application Ser. No. 843,135 filed Feb. 28, 1992; ethers and derivatives thereof; and mixtures thereof.

The lubricant and surface conditioner for aluminum cans in accordance with this invention in one embodiment preferably comprises a water-soluble derivative of a saturated fatty acid such as an ethoxylated stearic acid or an ethoxylated isostearic acid, or alkali metal salts thereof such as polyoxyethylated stearate and polyoxyethylated isostearate. Alternatively, the lubricant and surface conditioner for aluminum cans may comprise a water-soluble alcohol having at least about 4 carbon atoms and may contain up to about 50 moles of ethylene oxide. Excellent results have been obtained when the alcohol comprises polyoxyethylated oleyl alcohol containing an average of about 20 moles of ethylene oxide per mole of alcohol.

In another preferred aspect of this invention, the organic material employed to form a film on an aluminum can following alkaline or acid cleaning and prior to the last drying of the exterior surface prior to conveying comprises a water-soluble organic material selected from a phosphate ester, an alcohol, fatty acids including mono-, di-, tri-, and poly-acids fatty acid derivatives including salts, hydroxy acids, amides, alcohols, esters, ethers and derivatives thereof and mixtures thereof. Such organic material is preferably part of an aqueous solution comprising water-soluble organic material suitable for forming a film on the cleaned aluminum can to provide the surface after drying with a coefficient of static friction not more than 1.5 and that is less than would be obtained on a can surface of the same type without such film coating.

In one embodiment of the invention, water solubility can be imparted to organic materials by alkoxylation, preferably ethoxylation, propoxylation or mixture thereof. However, non-alkoxylated phosphate esters are also useful in the present invention, especially free acid containing or neutralized mono-and diesters of phosphoric acid with various alcohols. Specific examples include Tryfac™ 5573 Phosphate Ester, a free acid containing ester available from Henkel Corp.; and Triton™ H-55, Triton™ H-66, and Triton™ QS-44, all available from Union Carbide Corp.

Preferred non-ethoxylated alcohols include the following classes of alcohols:

Suitable monohydric alcohols and their esters with inorganic acids include water soluble compounds containing from 3 to about 20 carbons per molecule. Specific examples include sodium lauryl sulfates such as Duponol™ WAQ and Duponol™ QC and Duponol™ WA and Duponol™ C available from Witco Corp. and proprietary sodium alkyl sulfonates such as Alkanol™ 189-S available from E.I. du Pont de Nemours & Co.

Suitable polyhydric alcohols include aliphatic or arylalkyl polyhydric alcohols containing two or more hydroxyl groups. Specific examples include glycerine, sorbitol, mannitol, xanthan gum, hexylene glycol, gluconic acid, gluconate salts, glucoheptonate salts, pentaerythritol and derivatives thereof, sugars, and alkylpolyglycosides such as APG™300 and APG™ 325, available from Henkel Corp. Especially preferred polyhydric alcohols include triglycerols, especially glycerine or fatty acid esters thereof such as castor oil triglycerides.

In accordance with the present invention, we have discovered that employing alkoxylated, especially ethoxylated, castor oil triglycerides as lubricants and surface conditioners results in further improvements in can mobility especially where operation of the can line is interrupted causing the cans to be exposed to elevated temperatures for extended periods. Accordingly, especially preferred materials include Trylox™5900, Trylox™5902, Trylox™5904, Trylox™5906, Trylox™5907, Trylox™5909, Trylox™5918, and hydrogenated castor oil derivatives such as Trylox™5921 and Trylox™5922, all available from Henkel Corp.

Preferred fatty acids include butyric, valeric, caproic, caprylic, capric, pelargonic, lauric, myristic, palmitic, oleic, stearic, linoleic, and ricinoleic acids; malonic, succinic, glutaric, adipic, maleic, tartaric, gluconic, and dimer acids; and salts of any of these; iminodipropionate salts such as Amphoteric N and Amphoteric 400 available from Exxon Chemical Co.; sulfosuccinate derivatives such as Texapon™SH-135 Special and Texapon™SB-3, available from Henkel Corp.; citric, nitrilotriacetic, and trimellitic acids; Versenol™120 HEEDTA, N-(hydroxyethyl)ethylenediaminetriacetate, available from Dow Chemical Co.

Preferred amides generally include amides or substituted amides of carboxylic acids having from four to twenty carbons. Specific examples are Alkamide™ L203 lauric monoethanolamide, Alkamide™ L7DE lauric/myristic alkanolamide, Alkamikde™ DS 280/s stearic diethanolamide, Alkamide™CD coconut diethanolamide, Alkamide™ DIN 100 lauric/linoleic diethanolamide, Alkamide™ DIN 295/s linoleic diethanolamide, Alkamide™ DL 203 lauric diethanolamide, all available from Rh6ne-Poulenc; Monamid™ 150-MW myristic ethanolamide, Monamid™ 150-CW capric ethanolamide, Monamid™ 150-IS isostearic ethanolamide, all available from Mona Industries Inc.; and Ethomid™HT/23 and Ethomid™ HT60 polyoxyethylated hydrogenated tallow amines, available from Akzo Chemicals Inc.

Preferred anionic organic derivatives generally include sulfate and sulfonate derivatives of fatty acids including sulfate and sulfonate derivatives of natural and synthetically derived alcohols, acids and natural products. Specific Examples: dodecyl benzene sulfonates such as Dowfax™ 2A1, Dowfax™ 2AO, Dowfax™ 3BO, and Dowfax™ 3B2, all available from Dow Chemical Co.; Lomar™ LS condensed naphthalene sulfonic acid, potassium salt available from Henkel Corp.; sulfosuccinate derivatives such as Monamate™ CPA sodium sulfosuccinate of a modified alkanolamide, Monamate™ LA-100 disodium lauryl sulfosuccinate, all available from Mona Industries; Triton™ GR-5M sodium dioctylsulfosuccinate, available from Union Carbide Chemical and Plastics Co.; Varsulf™ SBFA 30, fatty alcohol ether sulfosuccinate, Varsulf™ SBL 203, fatty acid alkanolamide sulfosuccinate, Varsulf™ S1333, ricinoleic monoethanolamide sulfosuccinate, all available from Sherex Chemical Co., Inc.

Another preferred group of organic materials comprise water-soluble alkoxylated, preferably ethoxylated, propoxylated, or mixed ethoxylated and propoxylated materials, most preferably ethoxylated, and non-ethoxylated organic materials selected from amine salts of fatty acids including mono-, di-, tri-, and poly-acids, amino fatty acids, fatty amine N-oxides, and quaternary salts, and water soluble polymers.

Preferred amine salts of fatty acids include ammonium, quaternary ammonium, phosphonium, and alkali metal salts of fatty acids and derivatives thereof containing up to 50 moles of alkylene oxide in either or both the cationic or anionic species. Specific examples include Amphoteric N and Amphoteric 400 iminodipropionate sodium salts, available from Exxon Chemical Co.; Deriphat™ 154 disodium N-tallow-beta iminodipropionate and Deriphat™ 160, disodium N-lauryl-beta imino- dipropionate, available from Henkel Corp.

Preferred amino acids include alpha and beta amino acids and diacids and salts thereof, including alkyl and alkoxyiminodipropionic acids and their salts and sarcosine derivatives and their salts. Specific examples include Armeen™ Z, N-coco-beta-aminobutyric acid, available from Akzo Chemicals Inc.; Amphoteric N, Amphoteric 400, Exxon Chemical Co.; sarcosine (N-methyl glycine); hydroxyethyl glycine; Hamposyl™ TL-40 triethanolamine lauroyl sarcosinate, Hamposyl™ O oleyl sarcosinate, Hamposyl™ AL-30 ammoniumlauroyl sarcosinate, Hamposyl™ L lauroyl sarcosinate, and Hamposyl™ C cocoyl sarcosinate, all available from W.R. Grace & Co.

Preferred amine N-oxides include amine oxides where at least one alkyl substituent contains at least three carbons and up to 20 carbons. Specific examples include Aromox™ C/12 bis-(2-hydroxyethyl)cocoalkylamine oxide, Aromox™ T/12 bis-(2-hydroxyethyl)tallowalkylamine oxide, Aromox™ DMC dimethylcocoalkylamine oxide, Aromox™ DMHT hydrogenated dimethyltallowalkylamine oxide, Aromox™MDM-16 dimethylheaxdecylalkylamine oxide, all available from Akzo Chemicals Inc.; and Tomah™ AO-14-2 and Tomah™ AO-728 available from Exxon Chemical Co.

Preferred quatemary salts include quaternary ammonium derivatives of fatty amines containing at least one substituent containing from 12 to 20 carbon atoms and zero to 50 moles of ethylene oxide and/or zero to 15 moles of propylene oxide where the counter ion consists of halide, sulfate, nitrate, carboxylate, alkyl or aryl sulfate, alkyl or aryl sulfonate or derivatives thereof. Specific examples include Arquad™ 12–37W dodecyltrimethylammonium chloride, Arquad™ 18–50 octadecyltrimethylammonium chloride, Arquad™ 210–50 didecyldimethylammonium chloride, Arquad™ 218–100 dioctadecyldimethylammonium chloride, Arquad™ 316(W) trihexadecylmethylammonium chloride, Arquad™B-100 benzyldimethyl($C_{12-18}$)alkylammonium chloride, Ethoquad™ C/12 cocomethyl[POE(2)] ammonium chloride, Ethoquad™ C/25 cocomethyl[POE(15)]ammonium chloride, Ethoquad™ C/12 nitrate salt, Ethoquad™ T/13 Acetate tris(2-hydroxyethyl)tallowalkyl ammonium acetate, Duoqaud™ T-50 N,N,N' ,N' ,N'-pentamethyl-N-tallow- 1,3-diammonium dichloride, Propoquad™ 2HT/11 di(hydrogenated tallowalkyl)(2-hydroxy-2-methylethyl)methylammonium chloride, Propoquad™T/12 tallowalkylmethyl- bis- (2-hydroxy-2-methylethyl)-ammonium methyl sul-fate, all available from Akzo Chemicals Inc.; Monaquat™ PTS stearamidopropyl PG-diammonium chloride phosphate, available from Mona Industfides Inc.; Chemquat™ 12–33 lauryltrimethylammonium chloride, Chemquat™ 16–50 Cetyltrimethylammonium chloride available from Chemax Inc.; and tetraethylammonium pelargonate, laurate, myristate, oleate, stearate or isostearate.

Preferred water-soluble polymers include homopolymers and heteropolymers of ethylene oxide, propylene oxide, butylene oxide, acrylic acid and its derivatives, maleic acid and its derivatives, vinyl phenol and its derivatives, and vinyl alcohol. Specific examples include Carbowax™ 200, Carbowax™ 600, Carbowax™ 900, Carbowax™ 1450, Carbowax™ 3350, Carbowax™ 8000, and Compound 20M™, all available from Union Carbide Corp.; Pluronic™ L61, Pluronic™ L81, Pluronic™ 31R1, Pluronic™ 25R2, Tetronic™ 304, Tetronic™ 701, Tetronic™ 908, Tetronic™ 90R4, and Tetronic™ 150R1, all available from BASF Wyandotte Corp.; Acusol™ 410N sodium salt of polyacrylic acid, Acusol™ 445 polyacrylic acid, Acusol™ 460ND sodium salt of maleic acid/olefin copolymer, and Acusol™ 479N sodium salt of acrylic acid/maleic acid copolymer, all available from Rohm & Haas Company; and N-methylglucamine adducts of polyvinylphenol and N-methylethanolamine adducts of polyvinylphenol.

Additional improvements are achieved by combining in the process of this invention the step of additionally contacting the exterior of an aluminum can with an inorganic material selected from metallic or ionic zirconium, titanium, cerium, aluminum, iron, vanadium, tantalum, niobium, molybdenum, tungsten, hafnium or tin to produce a film combining one or more of these metals with one or more of the above-described organic materials. A thin film is produced having a coefficient of static friction that is not more than 1.5 and is preferably less than the coefficient without such film, thereby improving can mobility in high speed conveying without interfering with subsequent lacquering, other painting, printing, or other similar decorating of the containers.

The technique of incorporating such inorganic materials is described, in particular detail with reference to zirconium containing materials, in U.S. Pat. Nos. 5,030,323 of Jul. 9, 1991 and 5,064,500 of Nov. 12, 1991, the entire disclosures of which, to the extent not inconsistent with any explicit statement herein, are hereby incorporated herein by reference. The substitution of other metallic materials for those taught explicitly in one of these patents is within the scope of those skilled in the art.

In a further preferred embodiment of the process of the present invention, in order to provide improved water solubility, especially for the non-ethoxylated organic materials described herein, and to produce a suitable film on the can surface having a coefficient of static friction not more than 1.5 after drying, one employs a mixture of one or more surfactants, preferably alkoxylated and most preferably ethoxylated, along with such non-ethoxylated organic material to contact the cleaned can surface prior to final drying and conveying. Preferred surfactants include ethoxylated and non-ethoxylated sulfated or sulfonated fatty alcohols, such as lauryl and coco alcohols. Suitable are a wide class of anionic, non-ionic, cationic, or amphoteric surfactants. Alkyl polyglycosides such as $C_8$–$C_8$ alkyl polyglycosides having average degrees of polymerization between 1.2 and 2.0 are also suitable. Other classes of surfactants suitable in combination are ethoxylated nonyl and octyl phenols containing from 1.5 to 100 moles of ethylene oxide, preferably a nonylphenol condensed with from 6 to 50 moles of ethylene oxide such as Igepal™ CO-887 available from Rhône-Poulenc; alkyl/aryl polyethers, for example, Triton™ DF-16; and phosphate esters of which Triton™ H-66 and Triton™ QS-44 are examples, all of the Triton™ products being available from Union Carbide Co., and Ethox™ 2684 and Ethfac™ 136, both available from Ethox Chemicals Inc., are representative examples; polyethoxylated and/or polypropoxylated derivatives of linear and branched alcohols and derivatives thereof, as for example Trycol™ 6720 (Henkel Corp.), Surfonic™ LF-17 (Texaco) and Antarox™ LF-330 (Rh6ne-Poulenc); sulfonated derivatives of linear or branched aliphatic alcohols, for example, Neodol™ 25–3S (Shell Chemical Co.); sulfonated aryl derivatives, for example, Dyasulf™ 9268-A, Dyasulf™ C-70, Lomar™ D (all available from Henkel Corp.) and Dowfax™ 2A1 (available from Dow Chemical Co.); and ethylene oxide and propylene oxide copolymers, for example, Pluronic™ L-61, Pluronic™ 81, Pluronic™ 31R1, Tetronic™ 701, Tetronic™ 90R4 and Tetronic™ 150R1, all available from BASF Corp.

Further, the lubricant and surface conditioner for aluminum cans in accordance with this invention may comprise a phosphate acid ester or preferably an ethoxylated alkyl alcohol phosphate ester. Such phosphate esters are commercially available under the tradename Rhodafac™ PE 510 from Rh6ne-Poulenc Corporation, Wayne, NJ, and as Ethfac™ 136 and Ethfac™ 161 from Ethox Chemicals, Inc., Greenville, SC. In general, the organic phosphate esters may comprise alkyl and aryl phosphate esters with and without ethoxylation.

The lubricant and surface conditioner for aluminum cans may be applied to the cans during their wash cycle, during one of their treatment cycles such as cleaning or conversion coating, during one of their water rinse cycles, or more preferably (unless the lubricant and surface conditioner includes a metal cation as described above), during their final water rinse cycle. In addition, the lubricant and surface conditioner may be applied to the cans after their final water rinse cycle, i.e., prior to oven drying, or after oven drying, by fine mist application from water or another volatile non-inflammable solvent solution. It has been found that the lubricant and surface conditioner is capable of depositing on the aluminum surface of the cans to provide them with the desired characteristics. The lubricant and surface conditioner may be applied by spraying and reacts with the aluminum surface through chemisorption or physiosorption to provide it with the desired film.

Generally, in the cleaning process of the cans, after the cans have been washed, they are typically exposed to an acidic water rinse. In accordance with this invention, the cans may thereafter be treated with a lubricant and surface conditioner comprising an anionic surfactant such as a phosphate acid ester. The pH of the treatment composition is important and generally should be acidic, that is between about 1 and about 6.5, preferably between about 2.5 and about 5. If the cans are not treated with the lubricant and surface conditioner of this invention next after the acidic water rinse, the cans are often exposed to a tap water rinse and then to a deionized water rinse. In such event, the deionized water rinse solution is prepared to contain the lubricant and surface conditioner of this invention, which may comprise a nonionic surfactant selected from the aforementioned polyoxyethylated alcohols or polyoxyethylated fatty acids, or any of the other suitable materials as described above. After such treatment, the cans may be passed to an oven for drying prior to further processing.

The amount of lubricant and surface conditioner remaining on the treated surface after drying should sufficient to result in a COF value not more than 1.5, preferably not more than 1.2, more preferably not more than 1.0, or still more preferably not more than 0.80. Generally speaking, such amount should be on the order of from 3 $mg/m^2$ to 60 $mg/m^2$ of lubricant and surface conditioner on the outside surface of the cans. For reasons of economy, it is generally preferred that the aqueous lubricant and surface conditioner forming composition contain, with increasing preference in the order given, not more than 2.0, 1.0, 0.8, 0.6, 0.4, 0.30, or 0.20 grams per liter (often abbreviated hereinafter as "g/L") of the necessary organic material(s) to form the lubricant and surface conditioner film on the treated can surface after drying.

Embodiments of the Invention with Desirable Special Characteristics

In accordance with a particular preferred embodiment of this invention, it has been found that the coefficient of friction of a surface treated with a lubricant and surface conditioner is less easily damaged by heating when the lubricant and surface conditioner composition includes at least one of the following organic materials: alkoxylated or non-alkoxylated castor oil triglycerides and hydrogenated castor oil derivatives; alkoxylated and non-alkoxylated amine salts of a fatty acid including mono-, di-, tri-, and poly-acids; alkoxylated and non-alkoxylated amino fatty acids; alkoxylated and non-alkoxylated fatty amine N-oxides, alkoxylated and non-alkoxylated quaternary ammonium salts, alkyl esters of 2-substituted alkoxylated fatty alkyloxy acetic acids (briefly denoted hereinafter as "oxa-acid esters") as described more tully in U.S. application Ser. No. 843,135 filed Feb. 28, 1992, the disclosure of which is hereby incorporated herein by reference, and water-soluble alkoxylated and non-alkoxylated polymers. Furthermore, if the lubricant and surface conditioner is not applied to the surface from the last aqueous composition with which the surface is contacted before the last drying of the surface before automatic conveying, the composition including the organic materials preferably also includes a metallic element selected from the group consisting of zirconium, titanium, cerium, aluminum, iron, tin, vanadium, tantalum, niobium, molybdenum, tungsten, and hafnium in metallic or ionic form, and the film formed on the surface as part of the lubricant and surface conditioner in dried form should include some of this metallic element along with organic material.

For a fuller appreciation of the invention, reference should be made to the following examples, which are intended to be merely descriptive, illustrative, and not limiting as to the scope of the invention, except to the extent that their limitations may be incorporated into the appended claims.

Example Group 1

This example illustrates the amount of aluminum can lubricant and surface conditioner necessary to improve the mobility of the cans through the tracks and printing stations of an industrial can manufacturing facility, and also shows that the lubricant and surface conditioner does not have an adverse effect on the adhesion of labels printed on the outside surface as well as of lacquers sprayed on the inside surface of the cans.

Uncleaned aluminum cans obtained from an industrial can manufacturer were washed clean with an alkaline cleaner available from the Parker+Amchem Division, Henkel Corporation, Madison Heights, MI, employing that company's Ridoline™ 3060/306 process. The cans were washed in a CCW processing 14 cans at a time. The cans were treated with different amounts of lubricant and surface conditioner in ihe final rinse stage of the washer and then dried in an oven. The lubricant and surface conditioner comprised about a 10% active concentrate of polyoxyethylated isostearate, an ethoxylated nonionic surfactant, available under the tradename Ethox™ MI-14 from Ethox Chemicals, Inc., Greenville, SC. The treated cans were returned to the can manufacturer for line speed and printing quality evaluations. The printed cans were divided into two groups, each consisting of 4 to 6 cans. All were subjected for 20 minutes to one of the following adhesion test solutions:

Test Solution A: 1% Joy™ (a commercial liquid dishwashing detergent, Procter and Gamble Co.) solution in 3:1 deionized water:tap water at a temperature of 180° F.

Test Solution B: 1% Joy™ detergent solution in deionized water at a temperature of 212° F.

After removing the printed cans from the adhesion test solution, each can was cross-hatched using a sharp metal object to expose lines of aluminum which showed through the paint or lacquer, and tested for paint adhesion. This test included applying Scotch™ transparent tape No. 610 firmly over the cross-hatched area and then drawing the tape back against itself with a rapid pulling motion such that the tape was pulled away from the cross-hatched area. The results of the test were rated as follows: 10, perfect, when the tape did not peel any paint from the surface; 8, acceptable; and 0. total failure. The cans were visually examined for any print or lacquer pick-off signs.

In addition, the cans were evaluated for their coefficient of static friction using a laboratory static friction tester. This device measures the static friction associated with the surface characteristics of aluminum cans. This is done by using a ramp which is raised through an arc of 90° by using a constant speed motor, a spool and a cable attached to the free swinging end of the ramp. A cradle attached to the bottom of the ramp is used to hold 2 cans in horizontal position approximately 0.5 inches apart with the domes facing the fixed end of the ramp. A third can is laid upon the 2 cans with the dome facing the free swinging end of the ramp, and the edges of all 3 cans are aligned so that they are even with each other.

As the ramp begins to move through its arc, a timer is automatically actuated. When the ramp reaches the angle at which the third can slides freely from the 2 lower cans, a photoelectric switch shuts off the timer. It is this time, recorded in seconds, which is commonly referred to as "slip time". The coefficient of static friction is equal to the tangent of the angle swept by the ramp at the time the can begins to move. This angle in degrees is equal to [4.84 + (2.79.t)], where t is the slip time. In some cases the tested cans were subjected to an additional bake out at 210° C. for 5 minutes and the COF redetermined; this result is denoted hereinafter as "COF-2".

The average values for the adhesion test and coefficient of static friction evaluation results are summarized in Table 2. In brief, it was found that the lubricant and surface conditioner concentrate as applied to the cleaned aluminum cans provided improved mobility to the cans even at very low use concentrations, and it had no adverse effect on either adhesion of label print or internal lacquer tested even at 20 to 100 times the required use concentration to reduce the coefficient of static friction of the cans.

TABLE 2

| Test No. | Lubricant and Surface Conditioner Concentrate (%/vol.) | Adhesion Evaluation Test Solution | OSW | ISW | ID | Coefficient of Static Friction |
|---|---|---|---|---|---|---|
| 1 | Control (no treatment) | — | — | — | — | 1.42 |
| 2 | 0.1 | B | 10 | 10 | 10 | 0.94 |
| 3 | 0.25 | A | 10 | 10 | 10 | — |
| 4 | 0.5 | B | 9.5* | 10 | 10 | 0.80 |
| 5 | 0.75 | A | 10 | 10 | 10 | 0.63 |
| 6 | 1.0 | B | 10 | 10 | 10 | 0.64 |
| 7 | 2.0 | A | 10 | 10 | 10 | 0.56 |
| 8 | 5.0 | B | 10 | 10 | 10 | 0.55 |
| 9 | 10.0 | A | 9.8* | 10 | 10 | 0.56 |

Notes for Table 2
*Little pick-off was visually noticed on the outside walls, mainly at the contact marks.
"OSW" stands for outside sidewall, "ISW" stands for inside sidewall, and "ID" stands for inside dome.

Example Group 2

These examples illustrate the use of the aluminum can lubricant and surface conditioner of Example Group 1 in an industrial can manufacturing facility when passing cans through a printing station at the rate of 1260 cans per minute.

Aluminum can production was washed with an acidic cleaner (Ridolinep™ 125 CO, available from the Parker+ Amchem Division, Henkel Corporation, Madison Heights, MI), and then treated with a non-chromate conversion coating (Alodine™ 404, also available from the Parker+ Amchem Division, Henkel Corporation, Madison Heights, MI). The aluminum can production was then tested for "slip" and the exterior of the cans were found to have a static coefficient of friction of about 1.63. During processing of these cans through a printer station, the cans could be run through the printer station at the rate of 1150 to 1200 cans per minute without excessive "tripsp", i.e., improperly loaded can events. In such case, the cans are not properly loaded on the mandrel where they are printed. Each "trip" causes a loss of cans which have to be discarded because they are not acceptable for final stage processing.

About 1 ml/liter of aluminum can lubricant and surface conditioner was added to the deionized rinse water system of the can washer, which provided a reduction of the static coefficient of friction on the exterior of the cans to a value of 1.46 or a reduction of about 11 percent from their original value. After passing the cans through the printer, it was found that the adhesion of both the interior and exterior coatings were unaffected by the lubricant and surface conditioner. In addition, the printer speed could be increased to its mechanical limit of 1250 to 1260 cans per minute without new problems.

In similar fashion, by increasing the concentration of the aluminum can lubricant and the surface conditioner to the deionized rinse water system, it was possible to reduce the coefficient of static friction of the cans by 20 percent without adversely affecting the adhesion of the interior and exterior coatings of the cans. Further, it was possible to maintain the printer speed continuously at 1250 cans per minute for a 24-hour test period.

Example and Comparison Example Group 3

These examples illustrate the use of other materials as the basic component for the aluminum can lubricant and surface conditioner.

Aluminum cans were cleaned with an alkaline cleaner solution having a pH of about 12 at about 105° F. for about 35 seconds. The cans were rinsed, and then treated with three different lubricant and surface conditioners comprising various phosphate ester solutions. Phosphate ester solution 1 comprised a phosphate acid ester (available under the tradename Rhodafac™ PE 510 from Rhône-Poulenc, Wayne, NJ) at a concentration of 0.5 g/1. Phosphate ester solution 2 comprised an ethoxylated alkyl alcohol phosphate ester (available under the tradename Ethfac™ 161 from Ethox Chemicals, Inc., Greenville, SC) at a concentration of 0.5 g/1. Phosphate ester solution 3 comprised an ethoxylated alkyl alcohol phosphate ester (available under the tradename Ethfac™ 136 from Ethox Chemicals, Inc., Greenville, SC) at a concentration of 1.5 g/1.

The mobility of the cans in terms of coefficient of static friction was evaluated and found to be as follows in Table 3:

TABLE 3

| Phosphate ester solution | pH | Coefficient of static friction |
|---|---|---|
| 1 | 3.6 | 0.47 |
| 2 | 3.3 | 0.63 |
| 3 | 2.6 | 0.77 |
| None | — | 1.63 |

The aforementioned phosphate ester solutions all provided an acceptable mobility to aluminum cans, but the cans were completely covered with "water-break". It is desired that the cans be free of water-breaks, i.e., have a thin, continuous film of water thereon, because otherwise they contain large water droplets, and the water film is non-uniform and discontinuous. To determine whether such is detrimental to printing of the cans, they were evaluated for adhesion. That is, the decorated cans were cut open and boiled in a 1% liquid dishwashing detergent solution (Joy™) comprising 3:1 aleionized water:tap water for ten minutes. The cans were then rinsed in deionized water and dried. As in Example Group 1, eight cross-hatched scribe lines were cut into the coating of the cans on the inside and outside sidewalls and the inside dome. The scribe lines were taped over, and then the tape was snapped off. The cans were rated for adhesion values. The average value results are summarized in Table 4, in which the acronyms have the same meaning as in Table 2.

For the control, it was observed that there was no pick-off (loss of coating adhesion) on either the outside sidewall, the inside sidewall or the inside dome of the cans. For phosphate ester solution 1, it was observed that there was almost no pickoff on the outside sidewall, substantial pick-off on the inside sidewall, and complete failure on the inside dome of the cans. For phosphate ester solution 2, it was observed that there was almost no pick-off on the outside sidewall, and no pick-off on the inside sidewall and no pick-off on the inside dome of the cans.

TABLE 4

| Phosphate Ester | Adhesion Rating on: | | |
|---|---|---|---|
| Solution Used | OSW | ISW | ID |
| control | 10 | 10 | 10 |
| 1 | 9.8 | 6.8 | 1.0 |
| 2 | 9.8 | 10 | 10 |
| 3 | 10 | 10 | 10 |

For phosphate ester solution 3, it was observed that there was no pick-off on the outside sidewall, the inside sidewall, or the inside dome of the cans.

Example Group 4

This example illustrates the effect of the lubricant and surface conditioner of this invention on the water draining characteristics of aluminum cans treated therewith.

Aluminum cans were cleaned with acidic cleaner (Ridoline™ 125 CO followed by Alodine™ 404 treatment or Ridoline™ 125 CO only) or with an alkaline cleaner solution (Ridoline™ 3060/306 process), all the products being available from the Parker+Amchem Division, Henkel Corporation, Madison Heights, MI, and then rinsed with deionized water containing about 0.3% by weight of the lubricant and surface conditioner of this invention. After allowing the thus-rinsed cans to drain for up to 30 seconds, the amount of water remaining on each can was determined. The same test was conducted without the use of the lubricant and surface conditioner. The results are summarized in Table 5. It was found that the presence of the lubricant and surface conditioner caused the water to drain more uniformly from the cans, and that the cans remain "water-break" free for a longer time.

Example Group 5

This example illustrates the effect of the oven dryoff temperature on the sidewall strength of aluminum cans. This test is a quality control compression test which determines the column strength of the cans by measuring the pressure at which they buckle. The results are summarized in Table 6.

TABLE 5

| Drain Time | Grams per Can of Water Remaining Using: | |
|---|---|---|
| in Seconds | DI Water | DI Water + 0.3% Conditioner |
| 6 | 2.4–3.0 | nd |
| 12 | 2.1–3.5 | 2.8 |
| 18 | 2.2–3.5 | 2.3 |
| 30 | 1.8–3.4 | 2.3 |

TABLE 6

| Oven Temperature (°F.) | Column Strength (PSI) |
|---|---|
| 440 | 86.25 |
| 400 | 87.75 |
| 380 | 88.25 |
| 360 | 89.25 |

It can be seen from Table 6 that at an oven drying temperature of 380° F., a 2 psi increase was obtained in the column strength test compared to the value obtained at 440° F. oven temperature.

The higher column strength test results are preferred and required because the thin walls of the finished cans must withstand the pressure exerted from within after they are filled with a carbonated solution. Otherwise, cans having weak sidewalls will swell and deform or may easily rupture or even explode. It was found that the faster water film drainage resulting from the presence therein of the lubricant and surface conditioner composition of this invention makes it possible to lower the temperature of the drying ovens and in turn obtain higher column strength results. More specifically, in order to obtain adequate drying of the rinsed cans, the cans are allowed to drain briefly before entry into the drying ovens. The time that the cans reside in the drying ovens is typically between 2 and 3 minutes, dependent to some extent on the line speed, oven length, and oven temperature. In order to obtain adequate drying of the cans in this time-frame, the oven temperature is typically about 440° F. However, in a series of tests wherein the rinse water contained about 0.3% by weight of organic material to form a lubricant and surface conditioner of this invention, it was found that satisfactory drying of the cans could be obtained wherein the oven temperature was lowered to 400° F., and then to 370° F., and dry cans were still obtained.

Examples Group 6

Uncleaned aluminum cans from an industrial can manufacturer are washed clean in examples Type A with alkaline cleaner available from Parker+Amchem Division, Henkel Corporation, Madison Heights, Michigan, employing the Ridoline™ 3060/306 process and in Examples Type B with an acidic cleaner, Ridoline™ 125 CO from the same company. Following initial rinsing and before final drying, the cleaned cans are treated with a lubricant and surface conditioner comprised of about a 1% by weight active organic (I) in deionized water as specified in Table 7 below. In a separate set of examples, following initial rinsing and before final drying, the cleaned cans are treated with a reactive lubricant and surface conditioner comprised of about a 1% active organic (I) in deionized water plus about 2 g/L (0.2 wt%) of the inorganic (II) as specified in Table 7, below. In yet another set of examples, following initial rinsing and before final drying, the cleaned cans are treated with a lubricant and surface conditioner comprised of about 1% active organic (I) in deionized water plus about 0.5% by weight of surfactant (III) specified in Table 7 below. In a further set of examples, following initial rinsing and before final drying, the cleaned cans are treated with a reactive lubricant and surface conditioner forming component, in deionized water, comprised of about 1% active organic (I), about 0.2% inorganic (II), about 0.5% surfactant (III) as specified in Table 7 below. In all cases in this group of examples, the COF produced on the surface is less than 1.5.

Examples and Comparison Examples Group 7

In this group, various candidate materials for forming a lubricant and surface conditioner were tested at lower concentrations than in Group 6.

7.1 General Procedures. Mobility enhancer/rinse aid process solutions were prepared using deionized water with a conductivity less than 5 μsiemens; unless otherwise noted, all other solutions were prepared in tap water. Drawn and wall ironed aluminum cans were obtained from commercial factory production.

TABLE 7

| | Active Organic (I) | | | | |
|---|---|---|---|---|---|
| Example Type | Trade Name | Chemical Description | Inorganic (II) | Surfactant (III) | pH |
| A | Emery 657 | Caprylic acid | $Al_2(SO_4)_3$ | IGEPAL CO-887 | 2.2 |
| B | Emery 659 | Capric acid | $H_2ZrF_6$ | TRITON X-101 | 2.2 |
| A | Emery 651 | Lauric acid | $FeF_3$ | NEODOL 25-5-3 | 2.3 |
| B | Emery 655 | Myristic acid | $SnCl_4$ | TERGITOL TMN-6 | 2.3 |
| A | Emersol 143 | Palmitic acid 91% | $Ce(NO_3)_4$ | TRITON DF-16 | 2.6 |
| B | Emersol 153 NF | Stearic acid 92% | $H_2TiF_6$ | TRYCOL 6720 | 2.6 |
| A | Emersol 871 | Isostearic acid | $H_2HfF_6$ | ANTAROX LF-330 | 2.6 |
| B | Emersol 6313 NF | Oleic acid 75% | $(NH_4)_2ZrF_6$ | TRITON H-55 | 2.6 |
| A | Empol 1014 | Dimer acid 95% | $Fe_2(SO_4)_3$ | TRITON H-66 | 2.6 |
| B | Emery 1110 | Azelaic acid | $Al(NO_3)_3$ | TRITON QS-44 | 2.6 |
| B | Ethox MI5 | Ethoxylated isostearic acid | $TiCl_4$ | TRYCOL 6720 | 3.0 |
| A | Emulphor VN 430 | Polyoxyethylated oleic acid | $CeI_3$ | SURFONIC LF-17 | 3.0 |
| B | Ethox MO5 | Polyoxyethylated oleic acid | $FeF_3$ | LOMAR D | 3.0 |
| A | Monamide 150 LW | Lauric alkanolamide | $FeCl_3$ | DOWFAX 2A1 | 2.0 |
| B | Monamide 150 MW | Myristic alkanolamide | $FeBr_3$ | DYASULF 9268-A | 3.0 |
| A | Monamide 150 IS | Isostearic alkanolamide | $H_2ZrF_6$ | DYASULF C-70 | 4.0 |
| B | Monamide 718 | Stearic alkanolamide | $H_2TiF_6$ | IGEPAL CO-887 | 5.0 |
| A | Rhodafac BH 650 | Aliphatic phosphate ester, acid form | $Fe(NO_3)_3$ | POLYTERGENT SLF-18 | 2.0 |
| B | Ethox PP16 | Aromatic phosphate ester | $(NH_4)_2ZrF_6$ | PLURONIC L-61 | 3.0 |
| A | Rhodafac BL 750 | Aliphatic phosphate ester, acid form | $TaF_5$ | TETRONIC 701 | 6.0 |
| B | Rhodafac PE510 | Aromatic phosphate ester, acid form | $NbF_5$ | PLURONIC 31R1 | 5.0 |
| A | Ethfac 142W | Aliphatic phosphate ester | $H_2ZrF_6$ | PLURONIC 150R1 | 4.0 |
| B | Rhodafac RA 600 | Aliphatic phosphate ester, acid form | $(NH_4)_2MoO_4$ | APG 300 | 6.0 |
| A | Armeen Z | N-Coco-B-aminobutyric acid | $H_2TiF_6$ | TRITON CF-21 | 6.0 |
| B | Hamposyl L | Lauroyl sarcosine | $VF_4$ | TRITON DF-18 | 5.0 |
| A | Hamposyl C | Cocoyl sarcosine | $FeF_3$ | TRITON GR-7M | 4.0 |
| B | Hamposyl O | Oleoyl sarcosine | $SnCl_4$ | TRITON H-55 | 3.0 |

TABLE 7-continued

| Example Type | Active Organic (I) Trade Name | Chemical Description | Inorganic (II) | Surfactant (III) | pH |
|---|---|---|---|---|---|
| A | Hamposyl S | Stearyl sarcosine | $Al_2(SO_4)_3$ | TRITON X-100 | 2.0 |
| B | Acusol 410N | Polyacrylic acid, sodium salt, | $H_2ZrF_6$ | TRITON X-120 | 4.0 |
| B | Triton GR-5M | Dioctylsulfosuccinate | $Al(NO_3)_3$ | TRYCOL 5882 | 6.0 |
| A | Avanel S 70 | Sodium alkylether sulfonate | $VOSO_4$ | TRYCOL 5887 | 5.0 |
| B | Igepon TC-42 | Sodium N-coconut and N-methyl taurate | $VF_5$ | TRYCOL 5964 | 4.0 |
| A | Igepon TK-32 | Sodium N-methyl-N-tall oil acid taurate | $VF_5$ | IGEPAL CO-887 | 3.0 |
| B | Neodol 25-3A | Sulfonated linear alcohol, ammonium salt | $(NH_4)_2WO_4$ | IGEPAL CO-630 | 3.0 |
| A | Aromox C/12 | Bis(2-hydroxyethyl)cocamine oxide | $(NH_4)_2ZrF_6$ | NEODOL 25-3 | 3.0 |
| B | Aromox DMC | Dimethylcocamine oxide | $FeF_3$ | NEODOL 25-35 | 3.0 |
| A | Ethoquad 0/25 | Oleyl [POE(15)] ammonium chloride | $Fe_2(SO_4)_3$ | NEODOL 25-9 | 2.0 |
| B | Ethoquad C/12 | Cocomethyl [POE(2)] ammonium chloride | $Al_2(SO_4)_3$ | NEODOL 91-25 | 3.0 |
| A | Ethoquad 18/5 | Octadecyl [POE(15)] ammonium chloride | $Sn(SO_4)$ | TRITON QS-15 | 3.0 |
| B | Propoquad T/12 | Tallowalkylmethyl-bis-(2-hydroxy-2-methylethyl) ammonium methyl sulfate | $Ce_2(SO_4)_3$ | TRITON DF-12 | 2.0 |
| A | Ethfac 136 | Phosphate ester | $H_2ZrF_6$ | IGEPAL C0-887 | 2.3 |
| B | Ethox 2684 | Phosphate ester | $H_2ZRF_6$ | IGEPAL CO-887 | 2.7 |
| A | Trylox 5922 | Ethoxylated hydrogenated castor oil | $H_2ZrF_6$ | IGEPAL CO-887 | 2.3 |
| B | Trylox 5921 | Ethoxylated hydrogenated castor oil | $H_2TiF_6$ | IGEPAL CO-887 | 2.3 |
| A | Trylox 5925 | Ethoxylated hydrogenated castor oil | $H_2ZrF_6$ | TRITON H-66 | 2.7 |

Most cans were tested on a pilot scale beltwasher, a single track seven stage conveyor belt type washer (hereinafter denoted "BW") at its highest speed of 6.2 feet per minute ("fpm"). Alternatively, the CCW already noted, which processes 14 cans in a sequence of batch steps under microprocessor control, was employed. Both types of washer were capable of simulating the sequences, dwell and blow off characteristics of full scale production washers. Free Acidity and Fluoride Activities of the cleaner baths were determined as described in the P+A Technical Process Bulletin (No. 968) for Ridoline 124C. The cleaned and treated cans were dried in an electric forced air oven as described below. Can mobility was tested as in Group 1.

Foam heights were determined by placing 50 milliliters (hereinafter "mL") of the process solution in a 100 mL stoppered graduated cylinder and shaking vigorously for 10 seconds. The total volume of fluid, liquid plus foam, was determined immediately and after 5 minutes of standing. These "foam heights" will be referred to hereinafter as "IFH" (initial foam height) and "PFH" (persistent foam height) respectively.

The water break characteristics of cans treated with candidate final rinse mobility enhancers (FRME's) were evaluated by visually rating the amount of waterbreak on each of the four major surfaces of the can: interior dome and sidewall and exterior dome and sidewall. In this rating scheme a value of 2 is assigned to a completely waterbreak free surface, zero to a completely waterbroken surface and intermediate values to waterbreaks in between. Four cans are evaluated in this way and the scores totaled to give a number between 32 and 0, the waterbreak free (WBF) rating number.

7.2 Effect of Cleaner Bath Fluoride Activity On COF and

Reflectivity. The CCW and subsequent drying oven were used as follows:

| | |
|---|---|
| Stage 1 | tap water, 54.4° C., 30 sec. |
| Stage 2 | RIDOLINE ™ 124C, 15 mL Free Acid, 3.4 g total of surfactant, Fluoride Activity 10 to −20 mV in 10 mV increments, 60° C., 60 sec. |
| Stage 3 | tap water, 30 sec. |
| Stage 4 | deionized water, 90 sec. |
| Stage 5 | optional application of 0.4% ME-40 ™, 20 sec. |
| Stage 6 | not used |
| Oven | 5 minutes at 210° C. |

The "fluoride activity" noted for Stage 2 above is defined and can conveniently be measured by means of a fluoride sensitive electrode as described in U.S. Pat. No. 3,431,182 and commercially available from Orion Instruments. "Fluoride activity" as this term is used herein was measured relative to a 120E Activity Standard Solution commercially available from the Parker+Amchem ("P+A") Division of Henkel Corporation by a procedure described in detail in P+A Technical Process Bulletin No. 968. The Orion Fluoride Ion Electrode and the reference electrode provided with the Orion instrument are both immersed in the noted Standard Solution and the millivolt meter reading is adjusted to 0 with a Standard Knob on the instrument, after waiting if necessary for any drift in readings. The electrodes are then rinsed with deionized or distilled water, dried, and immersed in the sample to be measured, which should be brought to the same temperature as the noted Standard Solution had when it was used to set the meter reading to 0. The reading of the electrodes immersed in the sample is taken directly from the millivolt (hereinafter often abbreviated "mv" or "mV") meter on the instrument. With this instrument, lower positive mv readings indicate higher fluoride activity, and negative mv readings indicate still higher fluoride activity than any positive readings, with negative readings of high absolute value indicating high fluoride activity.

Figure 1A:
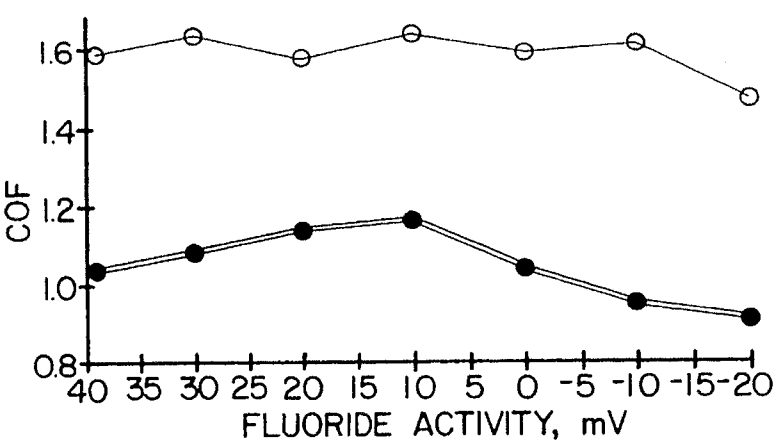
Figure 1D:
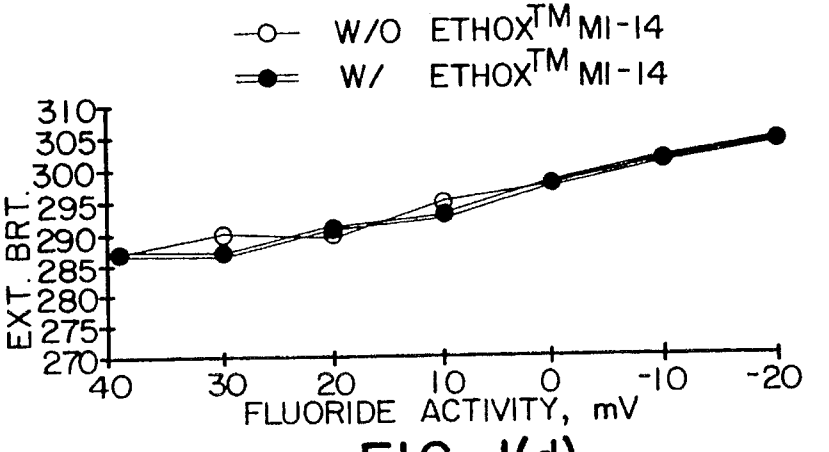
Figure 1C:
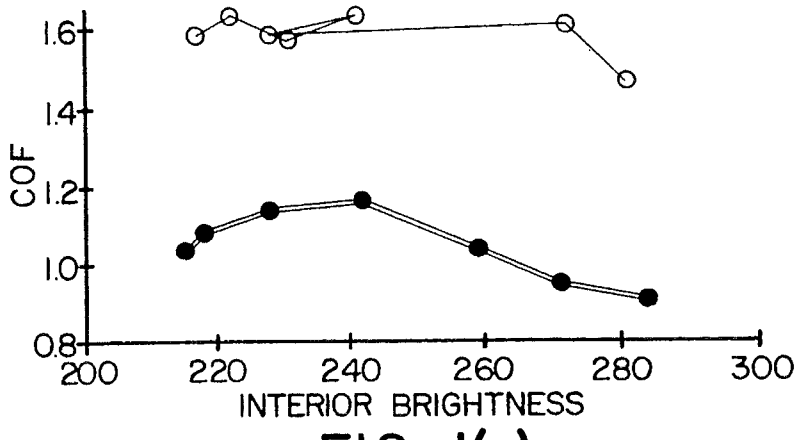

Effectiveness of soil removal was measured by use of the "brightness tester." This device consisted of a power stabilized high intensity lamp and a fiber optic bundle conveying the light to the can surface. The light reflected from the can impinged on a photocell whose current output was amplified and converted to a digital readout by an International Microtronics Inc. Model 350 amplifier; the number displayed was recorded as the brightness of the surface. The instrument is calibrated with a back silvered plane mirror to a measured reflectivity of 440. Once calibrated, the reflectivities of fourteen cans were measured and averaged. With this device it was possible to measure the overall interior reflectivity and exterior dome reflectivity. Results are shown in FIGS. 1(*a*)–1(*d*).

These results indicate that brightness increases monotonically within the range shown with increasing fluoride activity. COF values, in contrast, appear to peak at fluoride activities corresponding to about +10 mv readings and decrease slightly with either increases or decreases from that range. The variation of COF with fluoride activity level in these experiments is actually of relatively little practical importance, compared to the substantial improvement obtained by using a suitable FRME material.

If the results shown in FIGS. 1(*a*)–1(*d*) were the only practically important considerations, they would favor the highest fluoride activity levels. For several reasons, however, this has not been found to be true in commercial practice. High fluoride levels are more costly and promote high etching rates that may increase pollution abatement costs or even damage an etched container's ability to contain pressurized contents such as carbonated beverages. Also, in integrated commercial operations where there is a relatively short time between can formation and cleaning, the oily residues from can forming are easier to remove than in the laboratory experiments, where at least a few hours of time normally elapses between forming a set of cans and cleaning them. As a result of these factors, fluoride activity levels corresponding to electrode readings of from +50 to −10 mv have been found to be generally preferred, with electrode readings from +5 to 0 most preferred. As would be expected from the results shown in FIGS. 1(*b*) and 1(*d*), higher fluoride activities within these ranges are preferred when high brightness of the cans is required.

7.3 Screening of Diverse Materials For FRME Activity. The CCW was operated according to the following scheme, in which the extended Stage 3 rinse time simulated a production sequence wherein the normal Stage 3, 4, and 5 applications were used as rinses:

| | |
|---|---|
| Stage 1 | sulfuric acid, pH 2.0, 30 sec., 54.4° C. |
| Stage 2 | RIDOLINE ™ 124C, 15 mL Free Acid, 3.4 g/L total of surfactant, Fluoride Activity −10 mV, 90 sec., 54.4° C. |
| Stage 3 | deionized water, 150 sec. (ca. 17.7 L) |
| Stage 4 | as noted in Table 8, 30 sec., 29.4° C. temperature |
| Stage 5 | not used |
| Stage 6 | not used |

For this work Macamine™ SO was predissolved by adding 15% isopropanol. For the compositions containing Igepal™ 430 or polyvinyl alcohol, 1.6 g/L of Igepal™ CO-887 was added to obtain a homogeneous solution. Results are shown in Table 8. Among the candidate materials shown in Table 8, amine oxides with hydroxyethyl groups bonded to the amine oxide nitrogen, such as Aromox™ C/12 and T/12, and oxa-acid esters such as those identified in the table as OAE 1–4, are preferred lubricants and surface conditioners, as are the ethoxylated castor oil derivatives considered in more detail below.

7.4 Ethoxylated Castor Oil FRME's. The CCW was charged and operated as described in §7.3 with the exceptions that the Stage 3 deionized water rinse was applied for 130 sec and the first oven treatment was performed at 200° C. rather than 150° C. The Stage 4 compositions were as shown in Table 9. The experiment using Trylox™ 5921 included 0.2 g/L of Igepal™ CO-887 in an unsuccessful attempt to clarify the solution; a slight cloudiness persisted even in the presence of the cosurfactant.

7.5 The Effect of Ethylene Oxide Content On The Properties of Isostearyl FRME's And Binary Mixtures With Other Surfactants. The CCW was charged and operated as described in §7.3 with the Stage 4 variations shown in Table 10. The results in Table 10 indicate that only very slight defoaming at best was achievable with these defoamers. However, lower amounts of ethoxylation of the primary ethoxylated isostearic

TABLE 8

CANDIDATE FINAL RINSE MOBILITY ENHANCERS AND COMPARISONS

| Candidate or Comparison | Chemical Class | Hydrophobe | Hydrophile | Molecular Weight | HLB | COF Mean | COF StD | COF-2 Mean | COF-2 StD | IFH | PFH | WBF |
|---|---|---|---|---|---|---|---|---|---|---|---|---|
| None | — | — | — | — | — | 1.168 | .108 | 1.126 | .071 | — | — | 32 |
| None | — | — | — | — | — | 1.098 | .129 | — | — | — | — | — |
| None | — | — | — | — | — | 1.141 | .151 | — | — | — | — | 32 |
| None | — | — | — | — | — | 1.331 | .263 | — | — | — | — | 32 |
| None | — | — | — | — | — | 1.362 | .194 | — | — | — | — | 32 |
| None | — | — | — | — | — | 1.295 | .197 | — | — | — | — | 32 |
| Surfynol ™ 420 | Acetylenic-EO | TMDD | (EO)1.3 | — | 4 | 1.363 | .201 | — | — | 59 | 50 | 32 |
| Surfynol ™ 440 | Acetylenic-EO | TMDD | (EO)3.5 | — | 8 | 1.404 | .276 | — | — | 56 | 51 | 32 |
| Surfynol ™ 465 | Acetylenic-EO | TMDD | (EO)10 | — | 13 | 1.623 | .549 | — | — | 70 | 53 | 31.8 |
| Dimethylforamide | Amide | — | — | 73.1 | — | 1.371 | .181 | — | — | 56 | 50 | 32 |
| Monamine ™ AD-100 | Amide | — | — | — | — | .457 | .020 | .645 | .127 | 74 | 73 | 32 |
| M-Pyrol ™ | Amine | — | — | — | — | 1.184 | .172 | — | — | 53 | 51 | 32 |
| Macamine ™ C-10 | Amine | — | — | — | — | 1.645 | .476 | — | — | 64 | 50 | 32 |
| Triethanolamine | Amine | — | — | — | — | 1.134 | .120 | — | — | 53 | 51 | 32 |
| Armox ™ T/12 | Amine Oxide | C12 (tallow) | N=O/2-hydroxyethyl | 366 | — | .548 | .129 | .672 | .107 | — | — | 32 |
| Aromox ™ C/12 | Amine Oxide | C12 (coco) | N=O/2-hydroxyethyl | — | — | .527 | .090 | 1.005 | .190 | 77 | 71 | 32 |
| Aromox ™ DM-16 | Amine Oxide | C16 | — | — | — | 1.519 | .202 | — | — | 54 | 54 | 32 |
| Macamine ™ CAO | Amine Oxide | Cocamidopropyl | N=O | — | — | 1.532 | .468 | — | — | 70 | 64 | 32 |
| Macamine ™ CO | Amine Oxide | Cocamine | N=O | — | — | 1.329 | .222 | — | — | 51 | 50 | 32 |
| Macamine ™ SO | Amine Oxide | Stearamine | N=O | — | — | 1.180 | .116 | — | — | 76 | 73 | 32 |
| Triton ™ RW-100 | Amine-(EO)10 | — | — | — | 16 | .802 | .179 | 1.136 | .132 | 69 | 61 | 32 |
| Triton ™ RW-50 | Amine-(EO)5 | — | — | — | 13 | 1.099 | .096 | — | — | 69 | 66 | 32 |
| Triton ™ RW-75 | Amine-(EO)7.5 | — | — | — | 15 | 1.001 | .130 | 1.496 | .430 | 71 | 62 | 32 |
| TEA Oleate | Amine-Fatty | — | — | — | — | 1.214 | .438 | 1.430 | .315 | 52 | 50 | 32 |
| Armeen ™ Z | Amphoteric | C12 | RCOOH/NH | — | — | .660 | .182 | 1.463 | .299 | 71 | 64 | 32 |
| APG ™ 300 | Glycoside | — | — | — | — | 1.146 | .201 | — | — | 75 | 66 | 32 |
| APG ™ 325 | Glycoside | — | — | — | — | 1.015 | .251 | 1.211 | .183 | 72 | 70 | 32 |
| Hostacor ™ BF | Borate | — | — | — | — | 1.211 | .157 | — | — | 53 | 51 | 32 |
| Hostacor ™ BS | Borate | — | — | — | — | 1.339 | .231 | — | — | 58 | 54 | 32 |
| OAE-1 | C-18 EO/PO | C-18/PO(1) | (EO)5 | — | — | .315 | .040 | .343 | .032 | — | — | 32 |
| OAE-2 | C16-18 EO | C16-18 | (EO)5 | — | — | .305 | .030 | .386 | .066 | — | — | 28 |
| OAE-3 | C8-10 EO | C8-10 | (EO)5 | — | — | .602 | .149 | .687 | .118 | — | — | 32 |
| OAE-4 | C8-18 EO | C8-18 | (EO)5 | — | — | .282 | .017 | .483 | .071 | — | — | 16 |
| Acrysol ™ LMW-45 | Carboxylic Acid | n/a | RCOO(−) | 4500 | — | 1.102 | .112 | — | — | 53 | 50 | 32 |
| Aminohexanoic Acid | Carboxylic Acid | C6 | RCOOH/NH2 | — | — | 1.491 | .495 | — | — | 50 | 50 | 32 |
| Citric Acid | Carboxylic Acid | — | — | 191.1 | — | 1.334 | .110 | — | — | 55 | 50 | 32 |
| Gantrez ™ S-95 | Carboxylic Acid | — | — | — | — | 1.353 | .356 | — | — | 59 | 52 | 32 |
| Gluconic acid | Carboxylic Acid | — | COOH/C—OH | — | — | 1.551 | .316 | — | — | 50 | 50 | 32 |
| Isoascorbic Acid | Carboxylic Acid | — | — | — | — | 1.251 | .201 | — | — | 51 | 50 | 32 |
| Mirawet ™ B | Carboxylic Acid | C4 | — | — | — | 1.299 | .294 | — | — | 59 | 52 | 32 |
| Potassium Biphthalate | Carboxylic Acid | — | — | 204.2 | — | 1.500 | .406 | — | — | 53 | 50 | 32 |
| Sodium Glucoheptonate | Carboxylic Acid | — | C—OH/RCOO(−) | 249.2 | — | 1.238 | .122 | — | — | 51 | 51 | 32 |
| Sodium Gluconate | Carboxylic Acid | — | C—OH/RCOO(−) | 218 | — | 1.329 | .147 | — | — | 51 | 50 | 32 |
| Tartaric Acid | Carboxylic Acid | — | — | — | — | 1.501 | .322 | — | — | 52 | 50 | 32 |

TABLE 8-continued

CANDIDATE FINAL RINSE MOBILITY ENHANCERS AND COMPARISONS

| Candidate or Comparison | Chemical Class | Hydrophobe | Hydrophile | Molecular Weight | HLB | COF Mean | COF StD | COF-2 Mean | COF-2 StD | IFH | PFH | WBF |
|---|---|---|---|---|---|---|---|---|---|---|---|---|
| Chemquat ™ SP-10 | Cationic | — | — | — | — | .990 | .125 | 1.538 | .162 | 56 | 51 | 32 |
| Tetronic ™ 701 | EO/PO | (PO)2.04 | (EO)13.7 | 3600 | 1–7 | .972 | .244 | 2.129 | .363 | 64 | 51 | 32 |
| Henkel ™ SF-7063 | EO/PO/Me-ester | C13/$CH_2$—C(=O)$OCH_3$ | (EO)8.5 | — | — | .287 | .038 | .374 | .049 | — | — | 32 |
| Ethox ™ MI-14 | Ester | C18 | (EO)14 | — | 13 | .402 | .044 | .474 | .048 | 70 | 67 | 32 |
| Ethox ™ MI-14 | Ester | C18 | (EO)14 | — | 13 | .492 | .076 | .558 | .146 | — | — | 32 |
| Ethox ™ MI-14 | Ester | C18 | (EO)14 | — | 13 | .426 | .042 | .708 | .133 | 68 | 67 | 32 |
| Ethox ™ MI-14 | Ester | C18 | (EO)14 | — | 13 | .458 | .080 | .841 | .241 | 67 | 63 | 32 |
| Ethox ™ MI-14 | Ester | C18 | (EO)14 | — | 13 | .455 | .087 | .841 | .274 | 66 | 64 | 32 |
| Ethox ™ MI-14 | Ester | C18 | (EO)14 | — | 13 | .432 | .061 | — | — | 67 | 63 | 32 |
| Ethox ™ MI-14 | Ester | C18 | (EO)14 | — | 13 | .468 | .090 | — | — | — | — | — |
| Brij ™ 30 | Fatty Alcohol | C12 | (EO)4 | — | — | .890 | .161 | 1.013 | .076 | — | — | 32 |
| Chemal ™ 2EH5 | Fatty Alcohol | 2-ethylhexanol | (EO)2 | — | — | 1.032 | .068 | 1.075 | .103 | — | — | 32 |
| Chemal ™ PA-5P8 | Fatty Alcohol | C-10 LA/PO | EO | — | — | .815 | .200 | .725 | .132 | 57 | 50 | 32 |
| Ethal ™ 2EH2 | Fatty Alcohol | 2-ethyl hexanol | (EO)2 | — | 8.1 | 1.167 | .118 | 1.149 | .146 | — | — | 32 |
| Ethal ™ CSA-10 | Fatty Alcohol | C16-18 | (EO)12 | — | — | .748 | .164 | .761 | .166 | high | — | 32 |
| Ethal ™ CSA-17 | Fatty Alcohol | C16-18 | (EO)17 | — | — | .726 | .177 | .677 | .167 | — | — | 32 |
| Ethal ™ DA-6 | Fatty Alcohol | C10 | (EO)6 | — | 12.4 | .931 | .201 | 1.045 | .155 | — | — | 32 |
| Ethal ™ OA-23 | Fatty Alcohol | C18 | (EO)23 | — | 15.8 | .698 | .175 | .749 | .192 | — | — | 32 |
| Ethal ™ TDA-6 | Fatty Alcohol | C13 | (EO)6 | — | 11.4 | .764 | .179 | .930 | .163 | — | — | 32 |
| Sandoxylate ™ SX-408 | Fatty Alcohol | i-C10-12 LA/PO | EO | — | 11 | .913 | .107 | .885 | .105 | — | — | 32 |
| Sandoxylate ™ SX-424 | Fatty Alcohol | i-C10-12 LA/PO | EO | — | 15 | .688 | .160 | .676 | .137 | — | — | 32 |
| Sandoxylate ™ SX-602 | Fatty Alcohol | i-C10-12 LA/PO | EO | — | 8 | .966 | .132 | 1.145 | .175 | — | — | 32 |
| Triton ™ XL-80N | Fatty Alcohol | C8-10 EO/PO/EO | EO | 420 | — | .801 | .187 | .776 | .156 | — | — | 32 |
| Varonic ™ MT-42 | Fatty Alcohol | C12-18 CH3 cap | EO | — | — | .549 | .093 | .581 | .156 | — | — | 32 |
| Varonic ™ MT-48 | Fatty Alcohol | C12-18 CH3 cap | EO | — | — | .583 | .146 | .692 | .180 | — | — | 32 |
| Varonic ™ MT-65 | Fatty Alcohol | C12-18 CH3 cap | EO | — | — | .814 | .171 | .862 | .122 | — | — | 32 |
| Fluorad ™ FC-126 | Fluorosurfactant | C7F15 | R—COONa | — | — | 1.335 | .233 | — | — | 65 | 50 | 0 |
| Kelig ™ 100 | Ligno-Sulfonate | — | — | — | — | 1.450 | .473 | — | — | 53 | 50 | 32 |
| Kelig ™ 400 | Ligno-Sulfonate | — | — | — | — | 2.022 | .773 | — | — | 54 | 51 | 32 |
| Igepal ™ 660 | NP-(EO)10 | Nonyl Phemol | (EO)10 | 660 | 13.2 | 1.527 | .555 | — | — | 70 | 65 | 32 |
| Igepal ™ 710 | NP-(EO)10.4 | Nonyl Phenol | (EO)10.4 | 678.5 | 13.6 | 1.330 | .329 | — | — | 75 | 67 | 32 |
| Igepal ™ 720 | NP-(EO)12 | Nonyl Phenol | (EO)12 | 748 | 14.2 | 1.524 | .423 | — | — | 76 | 71 | 32 |
| Igepal ™ 430 | NP-(EO)4 | Nonyl Phenyl | (EO)4 | 396 | 8.8 | .516 | .064 | .815 | .195 | 63 | 60 | 32 |
| Igepal ™ 610 | NP-(EO)7.5 | Nonyl Phenyl | (EO)7.5 | 570.9 | 12.2 | .693 | .170 | 1.021 | .176 | 63 | 60 | 32 |
| Carbowax ™ Methoxy PEG | PEG | O—CH3 | (EO)44.7 | 2000 | — | .766 | .222 | .886 | .199 | — | — | 32 |
| Carbowax ™ Methoxy PEG | PEG | O—CH3 | (EO)7.3 | 350 | — | .955 | .126 | 1.047 | .113 | — | — | 32 |
| Carbowax ™ Methoxy PEG | PEG | O—CH3 | (EO)112.8 | 5000 | — | .739 | .158 | .839 | .118 | — | — | 32 |
| Carbowax ™ Methoxy PEG | PEG | O—CH3 | (EO)16.3 | 750 | — | .927 | .236 | .915 | .190 | — | — | 32 |
| Carbowax ™ PEG 20M | PEG | — | (EO)n | 17500 | — | .663 | .149 | .934 | .155 | — | — | 32 |
| Carbowax ™ PEG-1450 | PEG | — | (EO)32.5 | 1450 | — | .778 | .158 | .854 | .229 | — | — | 32 |
| Carbowax ™ PEG-200 | PEG | — | (EO)4.15 | 200 | — | 1.122 | .140 | 1.050 | .114 | — | — | 32 |
| Carbowax ™ PEG-3350 | PEG | — | (EO)75.7 | 3350 | — | .747 | .105 | .921 | .149 | — | — | 32 |
| Carbowax ™ PEG-8000 | PEG | — | (EO)181.2 | 8000 | — | .778 | .188 | .840 | .162 | — | — | 32 |
| Carbowax ™ PEG-900 | PEG | — | (EO)19.5 | 900 | — | .819 | .199 | .865 | .212 | — | — | 32 |
| Dequest ™ 2000 | Phosphonate | — | N[CH2—P=O$(OH)_2]_3$ | 299 | — | 1.506 | .203 | — | — | 52 | 50 | 32 |

TABLE 8-continued

CANDIDATE FINAL RINSE MOBILITY ENHANCERS AND COMPARISONS

| Candidate or Comparison | Chemical Class | Hydrophobe | Hydrophile | Molecular Weight | HLB | COF Mean | COF StD | COF-2 Mean | COF-2 StD | IFH | PFH | WBF |
|---|---|---|---|---|---|---|---|---|---|---|---|---|
| Dequest ™ 2006 | Phosphonate | — | $Na_5N[CH_2—P=O(OH)_2]_3$ | 409 | — | 1.327 | .095 | — | — | 51 | 51 | 32 |
| Dequest ™ 2016 | Phosphonate | — | $[(C—CH_3OH)][P=O(Na)_2]_2$ | 294 | — | 1.271 | .209 | — | — | 51 | 51 | 32 |
| Dequest ™ 2054 | Phosphonate | — | $HMDA[CH_2—P=O(Na)_2]_4$ | 721 | — | 1.095 | .225 | — | — | 51 | 50 | 32 |
| Dequest ™ 2066 | Phosphonate | — | $Trien[CH_2—P=O(Na)_2]$ | 683 | — | 1.176 | .150 | — | — | 51 | 50 | 32 |
| Belzak ™ AC | Polyhydric | — | R—OH | — | — | 1.211 | .098 | — | — | 52 | 50 | 32 |
| Cerelose ™ 2001 | Polyhydric | — | — | — | — | 1.318 | .095 | — | — | 51 | 50 | 32 |
| Glycerine | Polyhydric | — | — | — | — | 1.335 | .134 | — | — | 51 | 50 | 32 |
| Hexylene glycol | Polyhydric | 2-Me,2,4-C5 diol | (C—OH)2 | — | — | 1.886 | .130 | — | — | 58 | 50 | 32 |
| Methocel ™ 40-200 | Polyhydric | — | — | — | — | .901 | .076 | 1.193 | .252 | 60 | 54 | 32 |
| Pentaerythritol | Polyhydric | — | — | — | — | 1.133 | .088 | — | — | 54 | 52 | 32 |
| Poly{vinyl alcohol} | Polyhydric | — | — | — | — | .479 | .067 | .982 | .420 | 71 | 67 | 32 |
| Sorbitol | Polyhydric | — | C—OH | 182 | — | 1.239 | .091 | — | — | 51 | 50 | 32 |
| Tripropylene Glycol | Polyhydric | — | — | — | — | 1.266 | .125 | — | — | 60 | 52 | 32 |
| Xanthan Gum | Polyhydric | — | — | — | — | 1.059 | .139 | — | — | 52 | 51 | 32 |
| SOMAT ™ | Proprietary | — | — | — | — | .714 | .161 | — | — | — | — | — |
| Tween ™ 20 | Sorbitan ester-$(EO)_{20}$ | C12 | EO | — | — | .601 | .100 | 1.146 | .498 | 59 | 68 | 32 |
| Dodecylbenzene Sulfonate | Sulfonate | C12—Ph | SO3(–) | — | — | .396 | .029 | .616 | .182 | 100 | 82 | 8.5 |
| Dowfax ™ 2A1 | Sulfonate | iso-C12—Ph (bis) | [SO3(–)]2 | 576 | — | .614 | .112 | .793 | .109 | 71 | 68 | 0 |
| Heptane Sulfonate | Sulfonate | C6 | C6—COOH | — | — | 1.214 | .436 | — | — | 52 | 50 | 32 |
| Nacconol ™ 90F | Sulfonate | — | — | — | — | .387 | .021 | .462 | .065 | 100 | 95 | 9 |

Notes for Table 3

"StD" here and in subsequent tables means "standard deviation from the mean." "WBF" means "waterbreak free rating". The multiple entries for "None" and for Ethox ™ MI-14 represent determinations with different lots of cans. The "OAE-" products have the general chemical formula: $RO—(C_3H_6O)_m—(C_2H_4O)_n—CH_2—C(O)O—CH_3$, with the straight chain alkyl group R ranging from 8 to 18 carbon atoms in length, "m" being 0 or 1, and "n" ranging from 5 to an average of 8.5.

TABLE 9

ETHOXYLATED HYDROGENATED CASTOR OIL DERIVATIVES AND COMPARISONS AS FINAL RINSE MOBILITY ENHANCERS

| Product | Grams/ | COF | | COF-2 | | | |
|---|---|---|---|---|---|---|---|
| Name | 8 Liters | Mean | StD | Mean | StD | IFH | PFH |
| None | 0 | 1.231 | .149 | — | — | — | — |
| Trylox ™ 5922 | 1.6 | .479 | .072 | .503 | .085 | 69 | 65 |
| Trylox ™ 5922 | 0.4 | .974 | .161 | 1.055 | .151 | 60 | 56 |
| Trylox ™ 5922 | 0.8 | 1.007 | .117 | 1.131 | .132 | 70 | 60 |
| Trylox ™ 5921 | 1.6 | .511 | .108 | .548 | .093 | 74 | 68 |
| Trylox ™ 5921 | 0.4 | 1.072 | .144 | 1.034 | .201 | 63 | 59 |
| Trylox ™ 5921 | 0.8 | .883 | .154 | .958 | .152 | 62 | 54 |
| Trylox ™ 5925 | 3.2 | .914 | .140 | 1.139 | .157 | 67 | 62 |
| Trylox ™ 5925 | 6.4 | 1.020 | .149 | 1.231 | .122 | 74 | 67 |

TABLE 9-continued

ETHOXYLATED HYDROGENATED CASTOR OIL DERIVATIVES AND COMPARISONS AS FINAL RINSE MOBILITY ENHANCERS

| Product | Grams/ | COF | | COF-2 | | | |
|---|---|---|---|---|---|---|---|
| Name | 8 Liters | Mean | StD | Mean | StD | IFH | PFH |
| Trylox ™ 5925 | 9.6 | .965 | .180 | 1.007 | .122 | 73 | 63 |
| Ethox ™ MI-14 | 1.6 | .621 | .118 | 1.059 | .144 | 75 | 70 |

stearic acid lubricant and surface conditioner forming composition result in less foam, with COF values that are fully adequate for most applications. Mixtures of the "defoamers" Pluronic™ 31R1 and Trycol™ 6720 with Ethox™ MI-9 produced somewhat more foam than compositions with an equal total amount of Ethox™ MI-9 alone, but also give further reductions in the COF. The interactions are evidently complex and difficult to predict.

7.6 Final Rinse Mobility Enhancers and Water Drainage Aids. The BW was operated as follows:

| | |
|---|---|
| Stage 1 | sulfuric acid, pH 2.0, 54.4° C. |
| Stage 2 | RIDOLINE 124C, 15 mL Free Acid, 3.4 g/L of total surfactant, Fluoride Activity −10 mV, 60° C. |
| Stage 3 | tap water |
| Stage 4 | not used |
| Stage 5 | deionized water |
| Stage 6 | as noted in Table 11, 0.2 g/L total active additive |

TABLE 10

EFFECT OF VARIATION OF DEGREE OF ETHOXYLATION IN PRIMARY LUBRICANT AND SURFACE CONDITIONER (ETHOXYLATED ISOSTEARIC ACID) AND OF VARIATION OF COSURFACTANT ADDED AS ATTEMPTED DEFOAMER

| COF | | Ethoxylated Isostearic Acid | | Defoamer | | | |
|---|---|---|---|---|---|---|---|
| Mean | StD | g/8L | # of EO per Molecule | g/8L | Name | IFH | PFH |
| 1.139 | .170 | 0 | — | 0 | — | — | — |
| 1.159 | .181 | 0 | — | 0 | — | — | — |
| 1.069 | .165 | 0 | — | 0 | — | — | — |
| 1.190 | .158 | 0 | — | 0 | — | — | — |
| 1.154 | .198 | 0 | — | 0 | — | — | — |
| 1.142 | .174 | (Average of result with above five can lots) | | | | | |
| .587 | .170 | 0 | — | 1.60 | Pluronic ™ 31R1 | 77 | 50 |
| .817 | .155 | 0 | — | 1.60 | Triton ™ DF-16 | 79 | 55 |
| .659 | .175 | 0 | — | 1.60 | Trycol ™ LF-1 | 50 | 50 |
| .499 | .099 | 1.60 | 9 | 0 | — | 55 | 55 |
| .478 | .072 | 1.20 | 9 | .40 | Pluronic ™ 31R1 | 61 | 58 |
| .479 | .093 | 1.20 | 9 | .40 | Triton ™ DF-16 | 63 | 62 |
| .423 | .027 | 1.20 | 9 | .40 | Trycol ™ LF-1 | 69 | 67 |
| .408 | .038 | .80 | 9 | .80 | Pluronic ™ 31R1 | 65 | 63 |
| .576 | .172 | .80 | 9 | .80 | Triton ™ DF-16 | 72 | 69 |
| .467 | .103 | .80 | 9 | .80 | Trycol ™ LF-1 | 65 | 63 |
| .496 | .122 | .40 | 9 | 1.20 | Pluronic ™ 31R1 | 67 | 64 |
| .628 | .176 | .40 | 9 | 1.20 | Triton ™ DF-16 | 78 | 76 |
| .656 | .194 | .40 | 9 | 1.20 | Trycol ™ LF-1 | 73 | 66 |
| .457 | .074 | 1.60 | 10.5 | 0 | — | 60 | 60 |
| .465 | .121 | 1.20 | 10.5 | .40 | Pluronic ™ 31R1 | 60 | 59 |
| .531 | .108 | 1.20 | 10.5 | .40 | Triton ™ DF-16 | 67 | 66 |
| .566 | .186 | 1.20 | 10.5 | .40 | Trycol ™ LF-1 | 65 | 65 |
| .583 | .114 | .80 | 10.5 | .80 | Pluronic ™ 31R1 | 58 | 57 |
| .564 | .142 | .80 | 10.5 | .80 | Triton ™ DF-16 | 72 | 72 |
| .550 | .114 | .80 | 10.5 | .80 | Trycol ™ LF-1 | 69 | 65 |
| .539 | .111 | .40 | 10.5 | 1.20 | Pluronic ™ 31R1 | 55 | 53 |
| .685 | .205 | .40 | 10.5 | 1.20 | Triton ™ DF-16 | 75 | 70 |
| .644 | .133 | .40 | 10.5 | 1.20 | Trycol ™ LF-1 | 77 | 62 |
| .444 | .104 | 1.60 | 14 | 0 | — | 76 | 75 |
| .477 | .098 | 1.60 | 14 | 0 | — | 77 | 75 |

TABLE 10-continued

EFFECT OF VARIATION OF DEGREE OF ETHOXYLATION IN PRIMARY LUBRICANT AND SURFACE CONDITIONER (ETHOXYLATED ISOSTEARIC ACID) AND OF VARIATION OF COSURFACTANT ADDED AS ATTEMPTED DEFOAMER

| COF | | Ethoxylated Isostearic Acid | | Defoamer | | | |
|---|---|---|---|---|---|---|---|
| Mean | StD | g/8L | # of EO per Molecule | g/8L | Name | IFH | PFH |
| .534 | .093 | 1.20 | 14 | .40 | Pluronic ™ 31R1 | 74 | 71 |
| .456 | .121 | 1.20 | 14 | .40 | Triton ™ DF-16 | 80 | 75 |
| .516 | .148 | 1.20 | 14 | .40 | Trycol ™ LF-1 | 81 | 80 |
| .505 | .106 | .80 | 14 | .80 | Pluronic ™ 31R1 | 82 | 79 |
| .532 | .128 | .80 | 14 | .80 | Triton ™ DF-16 | 85 | 84 |
| .456 | .078 | .80 | 14 | .80 | Trycol ™ LF-1 | 86 | 83 |
| .681 | .178 | .40 | 14 | 1.20 | Pluronic ™ 31R1 | 82 | 79 |
| .615 | .149 | .40 | 14 | 1.20 | Triton ™ DF-16 | 81 | 78 |
| .538 | .106 | .40 | 14 | 1.20 | Trycol ™ LF-1 | 80 | 76 |

TABLE 11

VARIATION OF WATER DRAINAGE WITH LINE SPEED AND ADDITIVE TO FINAL RINSE

| Lubricant and/or Water | Line Speed | Water Retention | | COF | | COF-2 |
|---|---|---|---|---|---|---|
| Drainage Promoting Additive | Setting | Mean | StD | Mean | StD | (Mean) |
| None | 100 | 31.72 | — | — | — | — |
| None | 100 | 30.44 | — | — | — | — |
| None | 70 | 28.40 | — | — | — | — |
| None | 70 | 28.29 | .81 | 1.446 | .071 | — |
| None | 70 | 27.02 | 1.00 | — | — | — |
| None | 40 | 23.34 | — | — | — | — |
| Ethox ™ MI-14 | 40 | 19.11 | — | — | — | — |
| Neodol ™ 91-2.5 | 70 | 15.65 | .37 | 1.356 | .211 | — |
| Pluronic ™ L-81 | 70 | 17.44 | .14 | 1.124 | — | — |
| Pluronic ™ L-61 | 70 | 17.71 | .09 | 1.206 | — | — |
| Neodol ™ 91-6 | 70 | 20.83 | .27 | 1.201 | .175 | — |
| Ethox ™ MI-14/ Pluronic ™ L-81 (1:1) | 70 | 21.02 | .53 | .728 | — | .970 |
| Ethox ™ MI-14/ Pluronic ™ L-61 (1:1) | 70 | 21.63 | .32 | .725 | — | .832 |
| Ethal ™ OA-23 | 70 | 21.64 | .72 | .919 | — | 1.141 |
| Ethox ™ MI-14 | 70 | 21.68 | .18 | — | — | — |
| Ethox ™ MI-14 | 70 | 21.69 | — | — | — | — |
| Ethox ™ MI-10.5 | 70 | 21.93 | .38 | .550 | — | .727 |
| Neodol ™ 91-8 | 70 | 22.55 | .30 | 1.009 | .204 | — |
| Ethox ™ MI-14/ Trylox ™ 5922 (1:1) | 70 | 24.07 | 1.00 | .581 | — | .707 |
| Trylox ™ 5925 | 70 | 24.62 | .92 | 1.090 | — | — |
| Trylox ™ 5922 | 70 | 25.21 | .97 | .581 | — | .680 |
| Trylox ™ 5921 | 70 | 25.88 | .26 | .546 | — | .645 |
| Ethox ™ MI-14 | 100 | 26.60 | — | — | — | — |

The line speed of this washer was controlled by a rheostat with the following approximate relationship between percentage of output and line speed in feet per minute:

| Setting: | 100% | Speed: | 6.2 fpm |
|---|---|---|---|
| | 70 | | 3.4 fpm |
| | 40 | | 1.8 fpm |

Three sets of 14 cans each were treated and collected at the end of the washer using tongs. The cans were stacked on a light gauge aluminum baking pan and weighed with the tongs taking care to lose as little water as possible during the manipulations. The cans, tongs and tray were then dried at 210° C. for ten minutes and reweighed. The average of three replicate runs was taken as an estimation of the water retention of the finished cans. A fourth set of cans was collected, dried at 210° C. for 3 minutes and tested to determine their COF. For those cases where the COF was less than 1.00 the COF-2 was determined. Results are shown in Table 11. Some surfactants were found that are better at promoting water drainage than the ethoxylated isostearic acids that are very effective in providing lubricant and surface conditioner films. However, the surfactants that are exceptionally good at promoting water drainage are much poorer than ethoxylated isostearic acids in reducing COF. Mixing the two types permits improvement in water drainage, while retaining the ability to achieve COF values that are adequate in many applications.

Examples and Comparison Examples Group 8

The combination of ethoxylated castor oil derivatives and fluozirconic acid shown in Table 8 above has been found to have an unexpected additional advantage, which is illustrated further in this group.

Some beverages packaged in aluminum cans are pasteurized, and unless the temperature and the composition(s) of the aqueous solution(s) with which cans are contacted during pasteurization are very carefully controlled, staining of the dome of the can often occurs during pasteurization. An FRME combining fluozirconic acid and hydrogenated castor oil derivatives in proper concentrations has been found to provide both protection against dome staining during pasteurization and adequate lowering of the COF for most purposes.

The can washing setup for this group of examples was:

| | |
|---|---|
| Stage 1 | sulfuric acid, pH 2.0, 30 sec. 54.4° C. |
| Stage 2 | RIDOLINE ™ 124C, 15 mL Free Acid, 3.4 g/L of total of surfactant, Fluoride Activity −10 mV, 90° C. 54.4° C. |
| Stage 3 | deionized water, 150 sec. (ca. 17.7 L) |
| Stage 4 | as noted in Table 7 and below, 20 sec. spray + 20 sec. dwell, 29.4° C. temperature |
| Stage 5 | not used |
| Stage 6 | not used |

In addition to the ingredients listed in Table 7, the solutions were all adjusted to pH 4.5 by addition of aqueous ammonia or nitric acid as required.

Dome staining was evaluated by first removing the domes from the treated cans with a can opener. The domes were then placed in a water bath containing 0.2 g/L of borax at 65.6° C. for 30 minutes, then rinsed in deionized water and dried in an oven. Staining resistance was evaluated visually by comparison with known satisfactory and unsatisfactory standards. Results are shown in Table 12.

TABLE 12

EFFECT OF CONCENTRATIONS OF ETHOXYLATED CASTOR OIL DERIVATIVE AND OF FLUOZIRCONIC ACID ON DOME STAINING RESISTANCE AND COEFFICIENT OF FRICTION

| Grams of $H_2ZrF_6$Liter | Grams of Trylox ™ 5921/Liter | COF | Pasteurization Protection Rating |
|---|---|---|---|
| 0 | 0 | 1.16 | Fail |
| 0 | 0.2 | 0.57 | Fail |
| 0.14 | 0.2 | 0.52 | Fail |
| 0.29 | 0.2 | 0.61 | Marginal |
| 0.58 | 0.2 | 0.63 | Pass |
| 1.16 | 0.2 | 0.70 | Pass |

The last two conditions shown in Table 12 are highly satisfactory with respect to both COF and dome staining resistance during pasteurization.

Examples and Comparison Examples Group 9

This group illustrates use with tin cans. Three types of materials were tried as lubricant and surface conditioner forming and water drainage promoting agents for tin cans: (i) Ethox™ MI-14; (ii) a combination of 1 part by weight of Pluronic™ 31R1 and 4 parts by weight of Plurafac™ D25; and (iii) Tergitol™ Min-Foam™ 1X. Of these, the Ethox™, Tergitol™, and Plurafac™ products are ethoxylated fatty acids or alcohols, with a poly{propylene oxide} block cap on the end of the poly{ethylene oxide} block in some cases, while the Pluronic™ is a block copolymer of ethylene and propylene oxides, with poly{propylene oxide} block caps on the ends of the polymers. All were used at a concentration of 0.2 g/L of active material with deionized water in a final rinse before drying, after an otherwise conventional tin can washing sequence. Water retention and COF values were measured as generally described above. Results are shown in Table 13.

TABLE 13

| Additive to Final Rinse | Mean COF Value | Percent Water Retention |
|---|---|---|
| None | 1.04 | 100% (Defined) |
| Ethox ™ | 0.70 | 83.6 |
| Pluronic ™/Plurafac ™ | 0.81 | 77.3 |
| Tergitol ™ | 0.82 | 78.6 |

The invention claimed is:

1. A process comprising the steps of cleaning a metal can with an aqueous acidic or alkaline cleaning solution, contacting at least one exterior surface of said metal can with an aqueous lubricant and surface conditioner forming composition comprising dissolved organic material, and subsequently drying the can, thereby forming a lubricant and surface conditioner film on the can surface to provide the surface of the can with a coefficient of static friction that is not more than 1.5, and subsequently conveying the cleaned and dried can via automatic conveying equipment to a location where it is lacquered or decorated by printing or both. wherein the improvement comprises selecting at least part of the dissolved organic material in said aqueous lubricant and surface conditioner forming composition from the group consisting of alkoxylated and nonalkoxylated castor oil triglycerides and hydrogenated castor oil derivatives.

2. A process according to claim 1, wherein the aqueous lubricant and surface conditioner forming composition also comprises in solution or dispersion at least one of the elements selected from zirconium, titanium, cerium, aluminum, iron, tin, vanadium, tantalum, niobium, molybdenum, tungsten, and hafnium in metallic or ionic form and the film formed on the can surface contains at least part of the metallic element or elements in addition to said organic material.

3. A process according to claim 2, wherein the aqueous lubricant and surface conditioner forming composition comprises ethoxylated castor oil derivatives and fluozirconic acid in amounts sufficient to impart to the treated can dome staining resistance during subsequent pasteurization of the contents of the can.

4. A process according to claim 2, comprising a step of contacting the can surface after its contact with said aqueous lubricant and surface conditioner forming composition but before final drying with an aqueous liquid that is distinct in composition from said aqueous lubricant and surface conditioner forming composition.

5. A process according to claim 1, wherein the aqueous lubricant and surface conditioner forming composition comprises dissolved organic material selected from the group consisting of alkoxylated and non-alkoxylated castor oil triglycerides and hydrogenated castor oil derivatives in sufficient amount that the coefficient of static friction of the treated can increases less upon heating of the treated can beyond the degree of heating needed for drying than does the coefficient of friction of a comparison can treated in the same way, except for substituting ethoxylated isostearic acid for all the alkoxylated and non-alkoxylated castor oil triglycerides and hydrogenated castor oil derivatives present in the lubricant and surface conditioner forming composition.

6. A process according to claim 1, wherein the can surface after its contact with said aqueous lubricant and surface conditioner forming composition is dried and conveyed before being contacted with any other aqueous liquid than the aqueous lubricant and surface conditioner forming composition.

7. A process according to claim 6 wherein the pH of the aqueous lubricant and surface conditioner forming composition is in the range from about 1 to about 6.5, the content of organic material in the aqueous lubricant and surface conditioner forming composition is not greater than about 1.0 g/L, and the can after drying has a coefficient of static friction that is not more than about 1.2.

8. A process according to claim 5 wherein the pH of the aqueous lubricant and surface conditioner forming composition is in the range from about 1 to about 6.5, the content of organic material in the aqueous lubricant and surface conditioner forming composition is not greater than about 1.0 g/L, and the can after drying has a coefficient of static friction that is not more than about 1.2.

9. A process according to claim 4 wherein the pH of the aqueous lubricant and surface conditioner forming composition is in the range from about 2 to about 5.5, the content of organic material in the aqueous lubricant and surface conditioner forming composition is not greater than about 0.6 g/L, and the can after drying has a coefficient of static friction that is not more than about 1.0.

10. A process according to claim 3 wherein the pH of the aqueous lubricant and surface conditioner forming composition is in the range from about 2 to about 5, the content of organic material in the aqueous lubricant and surface conditioner forming composition is not greater than about 0.6 g/L, and the can after drying has a coefficient of static friction that is not more than about 1.0.

11. A process according to claim 2 wherein the pH of the aqueous lubricant and surface conditioner forming composition is in the range from about 1 to about 6.5, the content of organic material in the aqueous lubricant and surface conditioner forming composition is not greater than about 1.0 g/L, and the can after drying has a coefficient of static friction that is not more than about 1.2.

12. A process according to claim 1 wherein the pH of the aqueous lubricant and surface conditioner forming composition is in the range from about 1 to about 6.5, the content of organic material in the aqueous lubricant and surface conditioner forming composition is not greater than about 1.0 g/L, and the can after drying has a coefficient of static friction that is not more than about 1.2.

13. A process according to claim 12 wherein the can is an aluminum can and said cleaning solution is an acidic cleaning composition with a fluoride ion activity indicated by a fluoride sensitive electrode reading in the range from about +50 to about −10 mv.

14. A process according to claim 11 wherein the can is an aluminum can and said cleaning solution is an acidic cleaning composition with a fluoride ion activity indicated by a fluoride sensitive electrode reading in the range from about +50 to about −10 mv.

15. A process according to claim 10 wherein the can is an aluminum can and said cleaning solution is an acidic cleaning composition with a fluoride ion activity indicated by a fluoride sensitive electrode reading in the range from about +50 to about −10 mv.

16. A process according to claim 9 wherein the can is an aluminum can and said cleaning solution is an acidic cleaning composition with a fluoride ion activity indicated by a fluoride sensitive electrode reading in the range from about +50 to about −10 mv.

17. A process according to claim 8 wherein the can is an aluminum can and said cleaning solution is an acidic cleaning composition with a fluoride ion activity indicated by a fluoride sensitive electrode reading in the range from about +50 to about −10 mv.

18. A process according to claim 1 wherein the can is an aluminum can and said cleaning solution is an acidic cleaning composition with a fluoride ion activity indicated by a fluoride sensitive electrode reading in the range from about +50 to about −10 mv.

* * * * *